US007218047B2

(12) United States Patent
Kawai

(10) Patent No.: US 7,218,047 B2
(45) Date of Patent: May 15, 2007

(54) INDIRECTLY HEATED ELECTRODE FOR GAS DISCHARGE TUBE

(75) Inventor: Koji Kawai, Hamamatsu (JP)

(73) Assignee: Hamamatsu Photonics K. K., Shizuoka (JP)

( * ) Notice: Subject to any disclaimer, the term of this patent is extended or adjusted under 35 U.S.C. 154(b) by 215 days.

(21) Appl. No.: 10/433,946

(22) PCT Filed: Dec. 13, 2001

(86) PCT No.: PCT/JP01/10941

§ 371 (c)(1),
(2), (4) Date: Jun. 9, 2003

(87) PCT Pub. No.: WO02/49071

PCT Pub. Date: Jun. 20, 2002

(65) Prior Publication Data

US 2004/0051435 A1 Mar. 18, 2004

(30) Foreign Application Priority Data

Dec. 13, 2000 (JP) ..... 2000-379360
Dec. 13, 2000 (JP) ..... 2000-379369

(51) Int. Cl.
*H01J 1/15* (2006.01)
*H01J 19/08* (2006.01)

(52) U.S. Cl. ..... 313/341; 313/343; 313/344; 313/345; 313/310

(58) Field of Classification Search ..... 313/337, 313/310, 341, 346 R, 591, 628, 631, 270, 313/275, 340, 37, 574; 315/46, 48, 49, 94, 315/101
See application file for complete search history.

(56) References Cited

U.S. PATENT DOCUMENTS

| | | | | | |
|---|---|---|---|---|---|
| 1,983,621 | A | * | 12/1934 | Siegmund et al. | 313/340 |
| 3,003,077 | A | * | 10/1961 | Thomas | 313/343 |
| 3,662,211 | A | * | 5/1972 | Millis | 313/340 |
| 3,736,458 | A | * | 5/1973 | Miller et al. | 313/344 |
| 4,441,048 | A | | 4/1984 | Takaoka et al. | 313/346 |
| 5,159,236 | A | * | 10/1992 | Kawai | 313/340 |
| 5,864,209 | A | * | 1/1999 | Clark | 313/622 |
| 2004/0051436 | A1 | * | 3/2004 | Kawai | 313/346 DC |

FOREIGN PATENT DOCUMENTS

| | | |
|---|---|---|
| GB | 444737 | 3/1936 |
| JP | 57-147860 | 9/1982 |
| JP | 62-56628 | 11/1987 |
| JP | 63-29439 | 2/1988 |
| JP | 02-220345 | 9/1990 |
| JP | 02-220346 | 9/1990 |
| JP | 04-306550 | 10/1992 |
| JP | 04-315761 | 11/1992 |

* cited by examiner

*Primary Examiner*—Mariceli Santiago
(74) *Attorney, Agent, or Firm*—Drinker Biddle & Reath LLP

(57) ABSTRACT

An indirectly heated cathode for gas discharge tube C1 comprises a heater 1, a double coil 2, a plate member 3, and a metal oxide 10. An electrical insulating layer 4 is formed on the surface of heater 1. Heater 1 is disposed at the inner side of double coil 2. Plate member 3 is disposed along the length direction of double coil 2 at the inner side of double coil 2, which is to be the discharge surface side, and is electrically connected to double coil 2. Also, plate member 3 is grounded by being connected to the ground terminal of heater 1. Metal oxide 10 is held by double coil 2 and disposed to be in contact with plate member 3. Metal oxide 10 is in contact with double coil 2.

7 Claims, 13 Drawing Sheets

Ebb[V]
160
120
0

HEATER [V]
10
0

ACROSS GND AND ANODE [V]
130
0

AUXILIARY LIGHTING CIRCUIT UNIT [V]
130
0

MAKE-AND-BREAK SWITCHING CIRCUIT UNIT [V]
90
0

NEGATIVE RESISTANCE [V]
30
0
ON
LIGHTING
OFF
A1
A2
A3

HEATER [mA]
300
0
0

ACROSS GND
AND ANODE [mA]
300
0

AUXILIARY LIGHTING
CIRCUIT UNIT [mA]
SEVERAL mA
0

MAKE-AND-BREAK
SWITCHING CIRCUIT
UNIT [MA]
300
0

NEGATIVE
RESISTANCE [mA]
300
0
ON
LIGHTING
OFF
A1
A2
A3

INDIRECTLY HEATED ELECTRODE FOR GAS DISCHARGE TUBE

TECHNICAL FIELD

The present invention concerns an indirectly heated electrode for gas discharge tube.

BACKGROUND ART

A known example of the abovementioned indirectly heated electrode for gas discharge tube is that which is disclosed in Japanese Examined Patent Publication No. 62-56628 (U.S. Pat. No. 4,441,048). The indirectly heated electrode for gas discharge tube (indirectly heated cathode for gas discharge tube) that is disclosed in Japanese Examined Patent Publication No. 62-56628 has an arrangement wherein a double coil is wound a plurality of turns around and fixed closely to the outer wall of a cylinder of good thermal conductivity, a uniform cathode surface is formed by applying a paste-form cathode material in the space inside the primary coil and between the secondary coil of the double coil, and providing a heater inside the cylinder.

DISCLOSURE OF THE INVENTION

An object of the present invention is to provide an indirectly heated electrode for gas discharge tube that can realize long electrode service life and stable discharge.

As a result of research, the present inventors made the following new findings. In a case where the potential distribution of the electrode (cathode) surface is non-uniform, since the heat generation amount is non-uniform accordingly, the density of thermion generation is also non-uniform and localized discharge (skewing of the discharge position) occurs. Localized discharge causes the cathode material (metal oxide that is the material likely to emit electrons) to undergo removal (sputtering) and stabilization (mineralization) by oxidation with the reduced metal, that is, causes degradation of the thermionic emission ability and movement of the discharge position to another position with better thermionic emission characteristics. By thus repeating localized degradation of thermionic emission, the electrode surface becomes degraded. The abovementioned movement of the discharge position also causes the discharge itself to become unstable.

Based on the above research results, the present invention provides an indirectly heated electrode for gas discharge tube comprising: a coil member, wound in coil form; a heater, disposed at the inner side of the coil member and having an electrical insulating layer formed on a surface thereof; a metal oxide, serving as a material likely to emit electrons and held by the coil member; and an electrical conductor, having a predetermined length and disposed at the inner side of the coil member and so as to be in contact with the coil member.

In the indirectly heated electrode for gas discharge tube of the present invention, since an equipotential surface is effectively formed at the rear surface (surface at the opposite side of the discharge surface) of the coil member by the electrical conductor and thermionic emission thus occurs over a wide region of the equipotential surface that is formed, the discharge area is increased, the electron emission amount per unit area (electron emission density) is increased, and the load placed on the discharge position is lightened. The occurrence of localized discharge can thus be restrained and long service life of the electrode can be realized. Since the movement of the discharge position is also restrained, stable discharge can be obtained over along period of time. Also due to the increase of the discharge area, even if the current density is slightly increased and the load is somewhat increased, that is, even if the discharge current is increased, the damage can be made less than that of the prior art, thus enabling the provision of an indirectly heated electrode for gas discharge tube of large discharge current with substantially the same shape as that of the prior art and enabling realization of pulse operation and large current operation.

Also, the electrical conductor is preferably put in contact with the metal oxide and in contact with a plurality of coil parts of the coil member. In this case, the potential of the discharge surface that is made up of a plurality of discharge points or discharge lines by the electrical conductor is made substantially uniform. The sputtering of the metal oxide and stabilization (mineralization) due to oxidation with the reduced metal, which are degradation factors, can thus be restrained, that is, the degradation of the thermionic emission ability can be restrained and the movement of the discharge position can be restrained as well. As a result, long service life and stable discharge of an electrode can be realized by a simple arrangement in which an electrical conductor is disposed so as to be in contact with a metal oxide.

Also, the electrical conductor is preferably a high-melting-point metal that has been formed to a mesh, a wire, or a plate. By the electrical conductor being such a high-melting-point metal that has been formed to a mesh, a wire, or a plate, an electrical conductor of an arrangement that can restrain the degradation of the thermionic emission ability and movement of the discharge position can be realized at low cost and in simpler manner. Also, since the electrical conductor will be a rigid body, it can be processed readily and can be put in close contact with the metal oxide. With the present application, "plate" shall refer inclusively to such shapes as a ribbon shape, foil shape, etc.

Also, the coil member is preferably a multiple coil, arranged by winding a coil having a mandrel in coil form. With such an arrangement, when a multiple coil is used, the metal oxide that is the material likely to emit electrons is held in a manner where it is sandwiched between the pitches (spacings), which are the gaps between the wire material that forms the coil. Since the distance between pitches is small and gap-like, the falling off the metal oxide due to vibration can be restrained. Also, since a plurality of pitches of gap-like structure exist, a large amount of metal oxide can be held, providing the effect of replenishing the metal oxide loss that accompanies the degradation with time during discharge. Furthermore, since a mandrel is provided, deformation of the multiple coil during processing can be restrained.

Also, the metal oxide is preferably an oxide of a single metal among barium (Ba), strontium (Sr), and calcium (Ca) or a mixture of oxides of these metals or contains an oxide of a rare earth metal. By the metal oxide being an oxide of a single metal among barium, strontium, and calcium or a mixture of oxides of these metals or containing an oxide of a rare earth metal, the work function of the electron emitting part can be made small effectively and the emission of thermions can thus be facilitated.

The present invention provides an indirectly heated electrode for gas discharge tube comprising: a coil member, wound in coil form; a heater, disposed at the inner side of the coil member and having an electrical insulating layer formed on a surface thereof; a high-melting-point metal, formed to a mesh, a wire, or a plate and disposed along the length direction of the coil member at the inner side of the coil member; and a metal oxide, serving as a material likely to emit electrons and held by the coil member so as to be in contact with the high-melting-point metal; and wherein the high-melting-point metal forms a plurality of contacts with the coil member and the coil member is grounded.

In the indirectly heated electrode for gas discharge tube of the present invention, since an equipotential surface is effectively formed at the rear surface (surface at the opposite side of the discharge surface) of the coil member by the high-melting-point metal that has been formed to a mesh, a wire, or a plate and thermionic emission thus occurs over a wide region of the equipotential surface that is formed, the discharge area is increased, the electron emission amount per unit area (electron emission density) is increased, and the load placed on the discharge position is lightened. The sputtering of the metal oxide and stabilization (mineralization) due to oxidation with the reduced metal, which are degradation factors, can thus be restrained, that is, the degradation of the thermionic emission ability can be restrained and long service life of the electrode can be realized. Since the movement of the discharge position is also restrained, stable discharge over a long period of time can be realized. Also, since the high-melting-point metal is a rigid body, it is easy to process and can be put in close contact with the metal oxide. Also, due to the increase of the discharge area, even if the current density is slightly increased and the load is somewhat increased, that is, even if the discharge current is increased, the damage can be made less than that of the prior art, thus enabling the provision of an indirectly heated electrode for gas discharge tube of large discharge current with substantially the same shape as that of the prior art and enabling realization of pulse operation and large current operation.

The present invention provides an indirectly heated electrode for gas discharge tube comprising: a coil member, wound in coil form; a heater, disposed at the inner side of the coil member and having an electrical insulating layer formed on a surface thereof; a high-melting-point metal, formed to a mesh, a wire, or a plate and disposed along the length direction of the coil member at the inner side of the coil member; and a metal oxide, serving as a material likely to emit electrons and held by the coil member so as to be in contact with the high-melting-point metal; and wherein the high-melting-point metal forms a plurality of contacts with the coil member and the high-melting-point metal is grounded.

In the indirectly heated electrode for gas discharge tube of the present invention, since an equipotential surface is effectively formed at the rear surface (surface at the opposite side of the discharge surface) of the coil member by the high-melting-point metal that has been formed to a mesh, a wire, or a plate and thermionic emission thus occurs over a wide region of the equipotential surface that is formed, the discharge area is increased, the electron emission amount per unit area (electron emission density) is increased, and the load placed on the discharge position is lightened. The sputtering of the metal oxide and stabilization (mineralization) due to oxidation with the reduced metal, which are degradation factors, can thus be restrained, that is, the degradation of the thermionic emission ability can be restrained and long service life of the electrode can be realized. Since the movement of the discharge position is also restrained, stable discharge over a long period of time can be realized. Also, since the high-melting-point metal is a rigid body, it is easy to process and can be put in close contact with the metal oxide. Also, due to the increase of the discharge area, even if the current density is slightly increased and the load is somewhat increased, that is, even if the discharge current is increased, the damage can be made less than that of the prior art, thus enabling the provision of an indirectly heated electrode for gas discharge tube of large discharge current with substantially the same shape as that of the prior art and enabling realization of pulse operation and large current operation.

The present invention provides an indirectly heated electrode for gas discharge tube comprising: a coil member, having a mandrel and wound in coil form; a heater, disposed at the inner side of the coil member and having an electrical insulating layer formed on a surface thereof; a high-melting-point metal, formed to a mesh, a wire, or a plate and disposed along the length direction of the coil member between the coil member and the heater; and a metal oxide, serving as a material likely to emit electrons and disposed so as to be in contact with the coil member; and wherein the high-melting-point metal forms a plurality of electrical contacts with the coil member and the coil member is grounded.

In the indirectly heated electrode for gas discharge tube of the present invention, since the coil member is grounded, thermions, secondary electrons, etc. are supplied via this coil member. Also, at the rear surface (surface at the opposite side of the discharge surface) of the coil member, since an equipotential surface is effectively formed on the cathode surface by the high-melting-point metal and the inner side part of the coil member and thermionic emission thus occurs over a wide region of the equipotential surface that is formed, the discharge area is increased, the electron emission amount per unit area (electron emission density) is increased, and the load placed on the discharge position is lightened. The sputtering of the metal oxide and stabilization (mineralization) due to oxidation with the reduced metal, which are degradation factors, can thus be restrained, that is, the degradation of the thermionic emission ability can be restrained and long service life of the electrode can be realized. Since the movement of the discharge position is also restrained, stable discharge over a long period of time can be realized. Since a mandrel is provided, deformation of the coil member during processing can be restrained. Also, due to the increase of the discharge area, even if the current density is slightly increased and the load is some what increased, that is, even if the discharge current is increased, the damage can be made less than that of the prior art, thus enabling the provision of an indirectly heated electrode for gas discharge tube of large discharge current with substantially the same shape as that of the prior art and enabling realization of pulse operation and large current operation.

The present invention provides an indirectly heated electrode for gas discharge tube comprising: a coil member, having a mandrel and wound in coil form; a heater, disposed at the inner side of the coil member and having an electrical insulating layer formed on a surface thereof; a high-melting-point metal, formed to a mesh, a wire or a plate and disposed along the length direction of the coil member at the outer side of the coil member between the coil member and the heater; and a metal oxide, serving as a material likely to emit electrons and disposed so as to be in contact with the coil member; and wherein the high-melting-point metal is in electrical contact with the coil member at a plurality of locations and the high-melting-point metal is set to a ground potential.

In the indirectly heated electrode for gas discharge tube of the present invention, since the high-melting-point metal is grounded, thermions, secondary electrons, etc. are supplied via this high-melting-point metal and the coil member. Also, since an equipotential surface is effectively formed at the cathode surface by the high-melting-point metal and the inner side part of the coil member and thermionic emission thus occurs over a wide region of the equipotential surface that is formed, the discharge area is increased, the electron emission amount per unit area (electron emission density) is increased, and the load placed on the discharge position is lightened. The sputtering of the metal oxide and stabilization (mineralization) due to oxidation with the reduced metal, which are degradation factors, can thus be restrained, that is, the degradation of the thermionic emission ability can be restrained and long service life of the electrode can be realized. Since the movement of the discharge position is also restrained, stable discharge over a long period of time can be realized. Since a mandrel is provided, deformation of the coil member during processing can be restrained. Also, due to the increase of the discharge area, even if the current density is slightly increased and the load is somewhat increased, that is, even if the discharge current is increased, the damage can be made less than that of the prior art, thus enabling the provision of an indirectly heated electrode for gas discharge tube of large discharge current with substantially the same shape as that of the prior art and enabling realization of pulse operation and large current operation.

It is favorable for the coil member to be a multiple coil arranged by winding a coil in coil form. With such an arrangement, the metal oxide that is the material likely to emit electrons is held in a manner where it is sandwiched between the pitches (spacings), which are the gaps between the wire material that forms the coil. Since the distance between pitches is small and gap-like, the falling off the metal oxide due to vibration can be restrained. Also, since a plurality of pitches of gap-like structure exist, a large amount of metal oxide can be held, providing the effect of replenishing the metal oxide loss that accompanies the degradation with time during discharge.

The present invention provides an indirectly heated electrode for gas discharge tube comprising: a coil member, wound in single coil form; a heater, disposed at the inner side of the coil member and having an electrical insulating layer formed on a surface thereof; a high-melting-point metal, formed to a mesh, a wire, or a plate, and disposed along the length direction of the coil member between the coil member and the heater; and a metal oxide, serving as a material likely to emit electrons and disposed so as to be in contact with the coil member; and wherein the high-melting-point metal forms a plurality of electrical contacts with the coil member and the coil member is grounded.

In the indirectly heated electrode for gas discharge tube of the present invention, since the coil member is grounded, thermions, secondary electrons, etc. are supplied via this coil member. Also, at the rear surface (surface at the opposite side of the discharge surface) of the coil member, since an equipotential surface is effectively formed on the cathode surface by the high-melting-point metal and the inner side part of the coil member and thermionic emission thus occurs over a wide region of the equipotential surface that is formed, the discharge area is increased, the electron emission amount per unit area (electron emission density) is increased, and the load placed on the discharge position is lightened. The sputtering of the metal oxide and stabilization (mineralization) due to oxidation with the reduced metal, which are degradation factors, can thus be restrained, that is, the degradation of the thermionic emission ability can be restrained and long service life of the electrode can be realized. Since the movement of the discharge position is also restrained, stable discharge over along period of time can be realized. Also, due to the increase of the discharge area, even if the current density is slightly increased and the load is somewhat increased, that is, even if the discharge current is increased, the damage can be made less than that of the prior art, thus enabling the provision of an indirectly heated electrode for gas discharge tube of large discharge current with substantially the same shape as that of the prior art and enabling realization of pulse operation and large current operation.

The present invention provides an indirectly heated electrode for gas discharge tube comprising: a coil member, wound in single coil form; a heater, disposed at the inner side of the coil member and having an electrical insulating layer formed on a surface thereof; a high-melting-point metal, formed to a mesh, a wire, or a plate, and disposed along the length direction of the coil member between the coil member and the heater; and a metal oxide, serving as a material likely to emit electrons and disposed so as to be in contact with the coil member; and wherein the high-melting-point metal forms a plurality of electrical contacts with the coil member and the coil member is grounded.

In the indirectly heated electrode for gas discharge tube of the present invention, since the high-melting-point metal is grounded, thermions, secondary electrons, etc. are supplied via this high-melting-point metal and the coil member. Also, since an equipotential surface is effectively formed at the cathode surface by the high-melting-point metal and the inner side part of the coil member and thermionic emission thus occurs over a wide region of the equipotential surface that is formed, the discharge area is increased, the electron emission amount per unit area (electron emission density) is increased, and the load placed on the discharge position is lightened. The sputtering of the metal oxide and stabilization (mineralization) due to oxidation with the reduced metal, which are degradation factors, can thus be restrained, that is, the degradation of the thermionic emission ability can be restrained and long service life of the electrode can be realized. Since the movement of the discharge position is also restrained, stable discharge over along period of time can be realized. Also, due to the increase of the discharge area, even if the current density is slightly increased and the load is somewhat increased, that is, even if the discharge current is increased, the damage can be made less than that of the prior art, thus enabling the provision of an indirectly heated electrode for gas discharge tube of large discharge current with substantially the same shape as that of the prior art and enabling realization of pulse operation and large current operation.

BEST MODE FOR CARRYING OUT THE INVENTION

Preferred embodiments of this invention's indirectly heated electrode for gas discharge tube shall now be described in detail with reference to the drawings. In the following description, the same symbol shall be used for the same elements or elements with the same functions and redundant description shall be omitted.

(First Embodiment)

Figure 1:
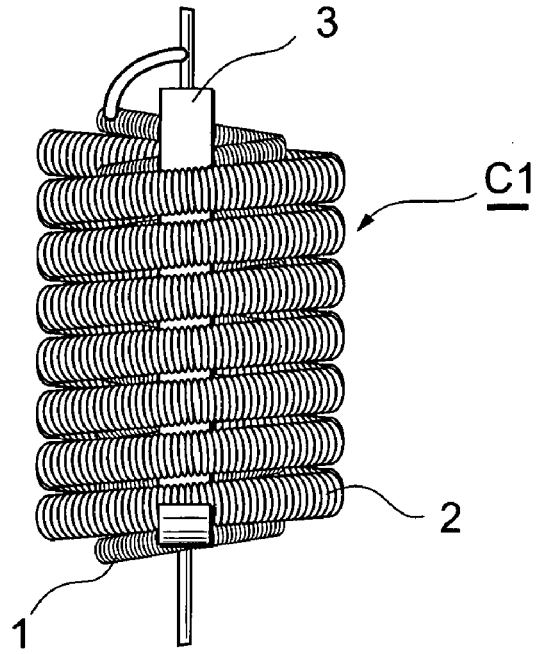
FIG. 1 is a schematic front view, showing an indirectly heated cathode for gas discharge tube of a first embodiment.
Figure 2:
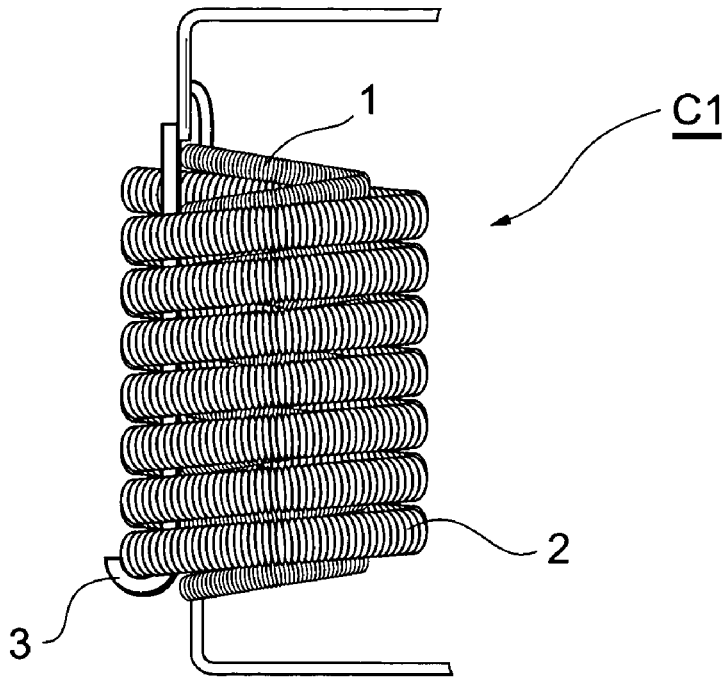
FIG. 2 is a schematic side view, showing an indirectly heated cathode for gas discharge tube of the first embodiment.
Figure 3A:
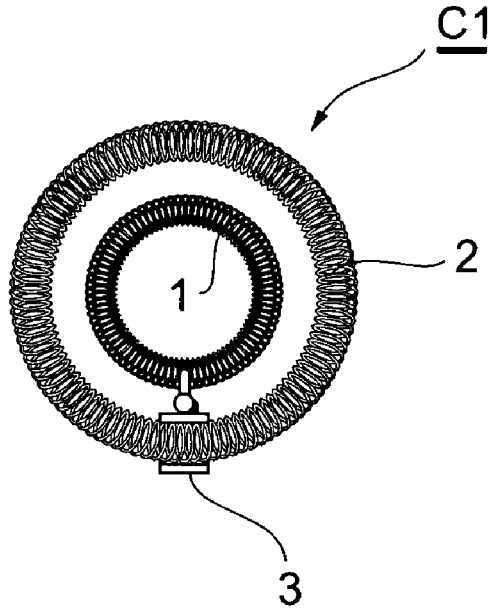
FIG. 3A is a schematic top view, showing an indirectly heated cathode for gas discharge tube of the first embodiment.
Figure 3B:
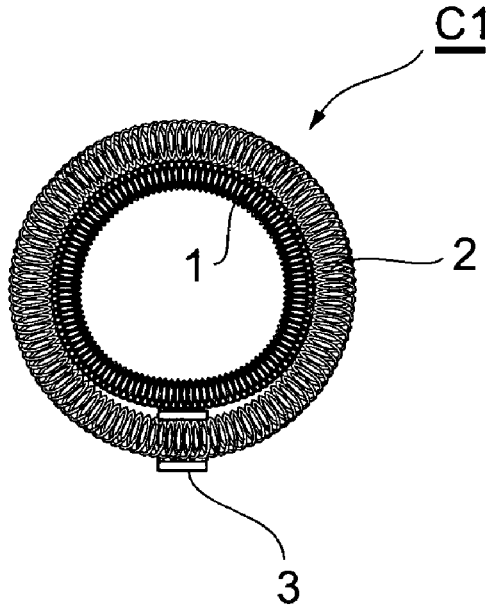
FIG. 3B is a schematic top view, showing an indirectly heated cathode for gas discharge tube of the first embodiment.
Figure 4:
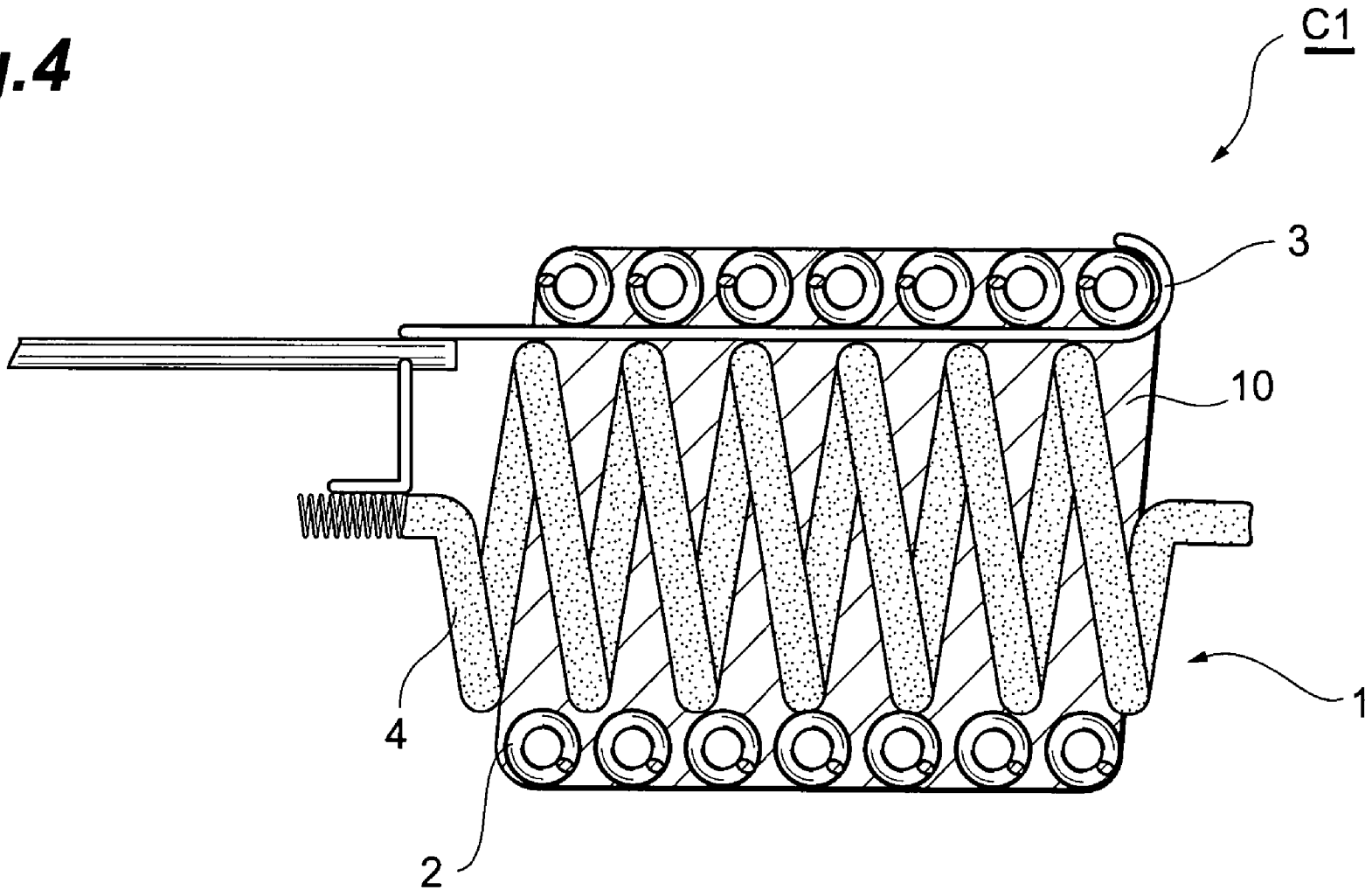
FIG. 4 is a schematic sectional view, showing an indirectly heated cathode for gas discharge tube of the first embodiment.

FIG. 1 is a schematic front view of an indirectly heated cathode for gas discharge tube of a first embodiment, FIG. 2 is likewise a schematic side view of an indirectly heated cathode for gas discharge tube of the first embodiment, FIG. 3 is likewise a schematic top view of indirectly heated cathodes for gas discharge tube of the first embodiment, and FIG. 4 is likewise a schematic sectional view of an indirectly heated cathode for gas discharge tube of the first embodiment. With FIGS. 1, 2, and 3, illustrations of an electrical insulating layer 4 and a metal oxide 10 are omitted for the sake of description. This embodiment is an example of application of an indirectly heated electrode for gas discharge tube to a cathode (indirectly heated cathode for gas discharge tube).

As shown in FIGS. 1 through 4, an indirectly heated cathode for gas discharge tube C1 has a heater 1, a double coil 2 as a coil member, a plate member 3 as an electrical conductor, and metal oxide 10 as a material likely to emit electrons (cathode material). Heater 1 comprises a filament coil, with which a tungsten element wire of 0.03 to 0.1 mm diameter, that is for example, a tungsten element wire of 0.07 mm diameter is wound in double, and an electrical insulating material (for example, alumina, zirconia, magnesia, silica, etc.) is coated by electrode position, etc. and formed as electrical insulating layer 4 on the surface of this tungsten filament coil. Also, an arrangement, which uses a cylindrical pipe of an electrical insulating material (for example, alumina, zirconia, magnesia, silica, etc.) and with which heater 1 is inserted inside this cylindrical pipe insulate heater 1, maybe employed in place of electrical insulating layer 4.

Double coil 2 is a multiple coil arranged from a coil that is wound in coil form, and a tungsten element wire of 0.091 mm diameter is formed into a primary coil with a diameter of 0.25 mm and a pitch of 0.146 mm and this primary coil is formed into a double coil with a diameter of 1.7 mm and a pitch of 0.6 mm. Heater 1 is inserted into and disposed at the inner side of double coil 2. As a coil member, a triple coil, etc. may be used in place of double coil 2.

Plate member 3 is a conductive rigid body (metal conductor) formed to plate, high-melting-point metal (with a melting point of at least 1000° C.) selected from among groups IIIa to VIIa, VIII, and Ib of the periodic table or, more specifically, from among tungsten, tantalum, molybdenum, rhenium, niobium, osmium, iridium, iron, nickel, cobalt, titanium, zirconium, manganese, chromium, vanadium, rhodium, rare earth metals, etc. or an alloy of these metals.

With the present embodiment, a tungsten plate member of 1.5 mm width and 25.4 μm thickness is used.

Plate member 3 is disposed so as to be substantially orthogonal to the discharge direction along the length direction of double coil 2 at the inner side of double coil 2 (between heater 1 and double coil 2). Plate member 3 is in a state where it is electrically connected to double coil 2. Also, plate member 3 contacts a plurality of coil parts at the inner side of double coil 2 and thus forms a plurality of contacts with double coil 2. Plate member 3 is grounded (set to GND) by being connected to the ground terminal of heater 1. By plate member 3 being grounded, double coil 2 is grounded as well. Also, in place of using plate member 3, a wire member that has been formed to a wire (for example, a tungsten element wire of approximately 0.1 mm diameter) may be used. Also, plate member 3 and double coil 2 may be welded together at the respective contact points.

Metal oxide 10 is held by double coil 2 and heater 1 and is put in contact with plate member 3. The surface of metal oxide 10 and the surface of double coil 2 are exposed to the outer side of indirectly heated cathode for gas discharge tube C1, and the surface part of double coil 2 is put in contact with the surface part of metal oxide 10.

As metal oxide 10, a single oxide of a metal selected from among barium (Ba), strontium (Sr), and calcium (Ca), or a mixture of such oxides, or an oxide, with which the principle component is a single oxide of a metal selected from among barium, strontium, and calcium or a mixture of such oxides and a sub-component is an oxide of a metal selected among rare earth metals including lanthanum (metals of group IIIa of the periodic table), is used. Each of barium, strontium, and calcium is low in work function, can emit thermions readily, and enable the thermion supply amount to be increased. Also, in a case where a rare earth metal (metal of group IIIa of the periodic table) is added as a sub-component, the thermion supply amount can be increased further and the sputter resistance can be improved as well.

As the cathode material, metal oxide 10 is coated in the form of a metal carbonate (f or example, barium carbonate, strontium carbonate, calcium carbonate, etc.) and obtained by vacuum thermal decomposition of the coated metal carbonate. If vacuum thermal decomposition is to be performed by passage of electricity through the heater 1, AC thermal decomposition is preferred over DC thermal decomposition. In the final stage, the metal oxide 10 that is thus obtained becomes the material likely to emit electrons.

The metal carbonate that is to be the cathode material is coated from the surface side of double coil 2 with heater 1 being positioned at the inner side of double coil 2 and plate member 3 being positioned at the inner side of double coil 2 that is to be the discharge surface side as shown in FIGS. 1 through 3B. The metal carbonate need not be coated so as to cover the entire periphery of indirectly heated cathode for gas discharge tube C1 (double coil 2) but may be coated onto just the part at the side at which plate member 3 is provided and which is to be the discharge surface side.

As shown in FIGS. 3B and 4, heater 1 is put in contact with metal oxide 10 and double coil 2 via electrical insulating layer 4. The heat of heater 1 can thus be transferred definitely and efficiently to metal oxide 10 and double coil 2 in the preheating process. Also, in comparison to an arrangement having a cylinder of good thermal conductivity, such as that of the indirectly heated cathode for gas discharge tube disclosed in Japanese Examined Patent Publication No. Sho 62-56628, the loss of the heat amount necessary for hot cathode operation can be restrained. This enable designs, which require neither the supplying of heat to the electrode from the exterior nor forced heating and with which the electrode will operate with just the heat amount provided by self-heating. When electrons are emitted from an electrode in a gas discharge tube, the ionized gas in the discharge space collides and causes electrical neutralization, and here, "self-heating" refers to the heat that is generated by the impact of collision of the gas molecules with the electrode.

Though besides the abovementioned metal oxides, the use of a metal boride, such lanthanum boride, a metal carbide, a metal nitride, etc. as the thermion supply source may be considered, metal borides, metal carbides, metal nitrides are poor in performance as a thermion supply source that can serve as a hot cathode for gas discharge tube and there is no meaning in adding such compounds as a principle component or a sub-component. However, such compounds may be used at peripheral parts of the cathode for effects besides the effect as a thermion supply source, such as for improving the insulation effect in order to restrain the amount of heat dissipation to parts besides the discharge part.

Here, consider the discharge at three predetermined discharge parts (designated as point 1A, point 1B, and point 1C, starting from the point closer to the ground (GND) that is the electron supply source) on the surface of double coil 2. The respective discharge parts 1A, 1B, and 1C have resistances R1A, R1B, and R1C corresponding to winding resistances from plate member 3 to double coil 2. Though the discharge current amount will differ according to the work function of each location, supposing that:

$$I1A>I1B>I1C \tag{1}$$

when the main discharge occurs at discharge part 1A, having a winding resistance R1A, the generation of heat (W) due to Joule heat, expressed by the following Equation (2), increases:

$$W=I1A^2\times R1A \tag{2}$$

and the lowering of the work function due to temperature rise occurs. Thus much of the discharge concentrates at this discharge part 1A, causing the degree of concentration of discharge to increase, and the discharge distribution becomes a continuous distribution of peaks with gradual unevenness. The greater the value of the winding resistance R1A, the greater the slope of the discharge distribution, and oppositely, as the value of the winding resistance R1A becomes small, the discharge distribution converges to a broad, gradual, single-peak continuous distribution.

Thus with indirectly heated cathode for gas discharge tube C1 of the present embodiment, since plate member 3 is disposed in contact with metal oxide 10 and double coil 2, plate member 3, along with the inner side part of double coil 2, effectively forms an equipotential surface at the rear surface (surface at the opposite side of the discharge surface) of double coil 2. That is, plate member 3 and the inner side part of double coil 2 are arranged with a plurality of electrical wiring (conduction paths) and do not restrict the flow of electrical current to a single direction. The electrical resistances across the ends of the surface of plate member 3 are thus considerably low, the surface of plate member 3 is put in a substantially equipotential state, and the potential of the discharge surface that comprises a plurality of discharge points or discharge lines will be substantially uniform. In other words, a plurality of electrical circuits, which enable discharge current to flow in directions parallel to the discharge surface, that is, a plurality of paths (equipotential circuits) for the discharge electrons (emission) are formed by plate member 3.

Thus with indirectly heated cathode for gas discharge tube C1, since an equipotential surface is formed effectively at the rear surface (surface at the opposite side of the discharge surface) of double coil 2 by plate member 3 and double coil 2, and thermionic emission thus occurs over a wide region of the equipotential surface that is formed, the discharge area is increased, the electron emission amount per unit area (electron emission density) is increased, and the load placed on the discharge position is lightened, and the sputtering of metal oxide 10 and stabilization (mineralization) due to oxidation with the reduced metal, which are degradation factors, can be restrained, in other words, the lowering of the thermionic emission ability can be restrained. As a result, the occurrence of localized discharge can be restrained and long service life of the cathode can be realized. Since the movement of the discharge position is also restrained, stable discharge over a long period of time can be realized. Also, since the discharge area is increased, the operation voltage and the generated heat amount of indirectly heated cathode for gas discharge tube C1 can be reduced.

Also, with indirectly heated cathode for gas discharge tube C1, due to the increase of the discharge area, even if the current density is slightly increased and the load is somewhat increased, that is, even if the discharge current is increased, the damage can be made less than that of the prior art. This enables the provision of an indirectly heated cathode for gas discharge tube of large discharge current with substantially the same shape as that of the prior art and the realization of pulse operation and large current operation.

Also since plate member 3 is used as the electrical conductor, an electrical conductor of an arrangement, which can restrain the degradation of the thermionic emission ability and the movement of the discharge position, can be realized at low cost and in a simpler manner. Also, since plate member 3 (electrical conductor) is a rigid body, it is easy to process and can be put in close contact with metal oxide 10. Furthermore, the locations at which plate member 3 contacts metal oxide 10 can be made numerous readily.

With indirectly heated cathode for gas discharge tube C1 of the present embodiment, since heater 1 is used as a core at the outer side of which double coil 2, which holds metal oxide 10, is positioned in a surrounding manner, and plate member 3 is positioned at the inner side of double coil 2 so as to be in contact with metal oxide 10, the vibration restraining effect of double coil 2 is put to work and the falling off of metal oxide 10 is thereby prevented. Also, since a large amount of metal oxide 10 will be held between the pitches of double coil 2, the effect of replenishing the metal oxide loss that accompanies the degradation with time during discharge is provided.

(Second Embodiment)

Figure 5:
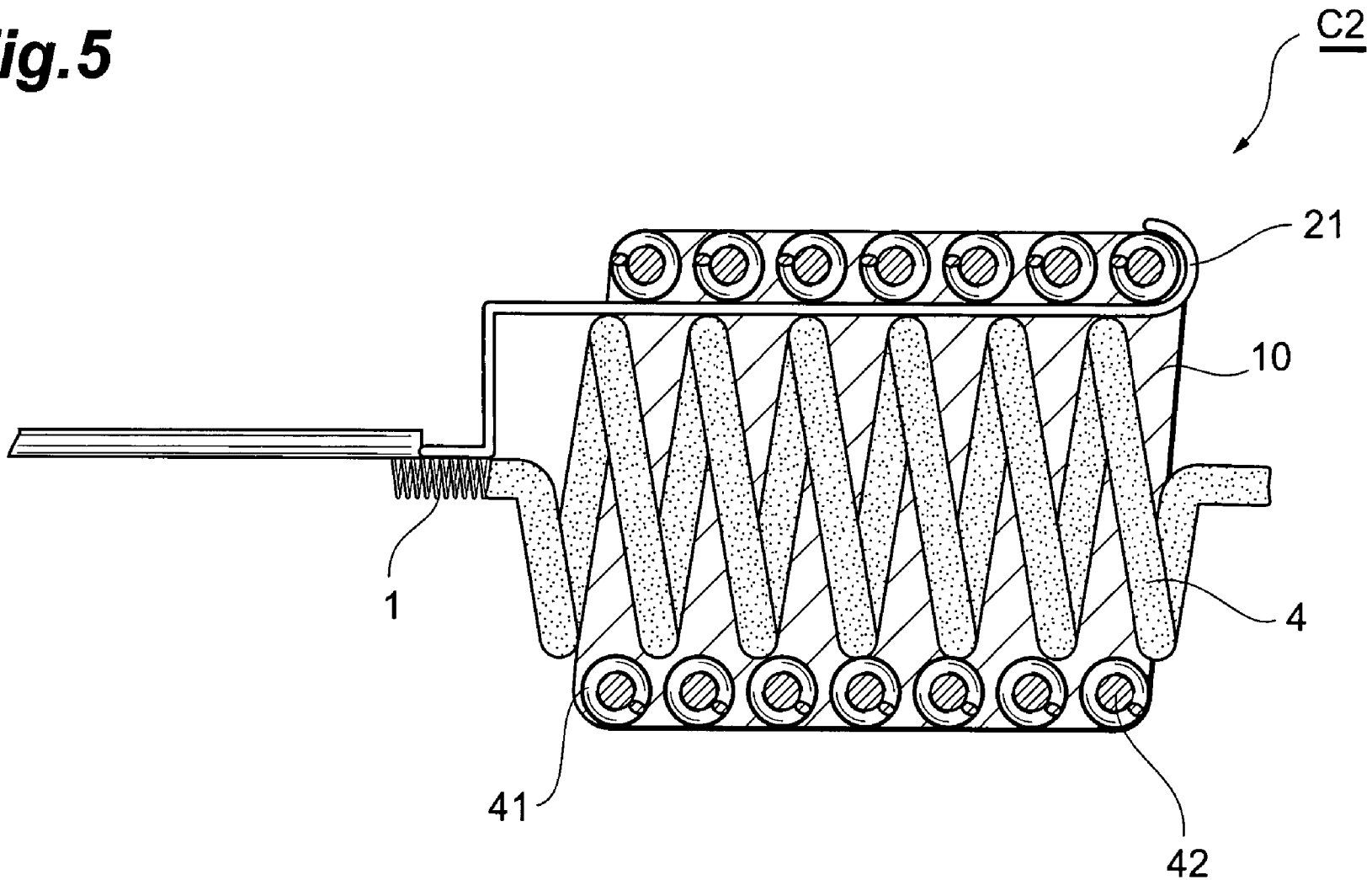
FIG. 5 is a schematic sectional view, showing an indirectly heated cathode for gas discharge tube of the second embodiment.

FIG. 5 is a schematic sectional view of an indirectly heated cathode for gas discharge tube of a second embodiment. The second embodiment differs from the first embodiment in that the double coil has a mandrel and the electrical conductor is a mesh member.

As shown in FIG. 5, indirectly heated cathode for gas discharge tube C2 has a heater 1, a double coil 41 as a coil member, a mesh member 21 as an electrical conductor, and a metal oxide 10 as a material likely to emit electrons.

Double coil 41, like double coil 2 of the first embodiment, is a multiple coil arranged from a coil wound in coil form and has a mandrel 42. Heater 1 is disposed at the inner side of double coil 41. Here, the mandrel is a core wire that serves the role of a mold that determines the winding diameter in the process of preparing the filament coil. As the material of the mandrel, for example, molybdenum is used.

Mesh member 21 is a conductive rigid body (metal conductor) formed of a single, high-melting-point metal (with a melting point of at least 1000° C.) selected from among groups IIIa to VIIa, VIII, and Ib of the periodic table or, more specifically, from among tungsten, tantalum, molybdenum, rhenium, niobium, osmium, iridium, iron, nickel, cobalt, titanium, zirconium, manganese, chromium, vanadium, rhodium, rare earth metals, etc. or an alloy of these metals. With the present embodiment, a mesh member made by weaving tungsten element wires of 0.03 mm diameter into mesh form is used. The mesh size of mesh member 21 is set to 80 mesh. Mesh member 21 has a prescribed length.

Mesh member 2 is disposed across the length direction of double coil 41 at the inner side of double coil 41 (between heater 1 and double coil 41) so as to be substantially orthogonal to the discharge direction. Mesh member 21 is put in a state where it is in electrical contact with double coil 41. Mesh member 21 also contacts a plurality of coil parts at the inner side of double coil 41 and forms a plurality contacts with double coil 41. Mesh member 21 is connected to the ground terminal of heater 1 and is thereby grounded (set to GND). By mesh member 21 being grounded, double coil 41 is also grounded.

Metal oxide 10 is held by double coil 41 and heater 1. The surface part of double coil 41 and metal oxide 10 are exposed to the outer side of indirectly heated cathode for gas discharge tube C2 so that the surface of metal oxide 10 and the surface part of double coil 41 make up a discharge surface and the surface part of metal oxide 10 is put in contact with the surface part of double coil 41. Metal oxide 10 is disposed in the same manner as in the first embodiment.

As shown in FIG. 5, heater 1 is in contact with metal oxide 10 and double coil 41 via electrical insulating layer 4. The heat of heater 1 can thus be transferred definitely and efficiently to metal oxide 10 and double coil 41 in the preheating process. Also, as with the first embodiment, the loss of the heat amount necessary for hot cathode operation can be restrained, and this enables designs, which require neither the supplying of heat to the electrode from the exterior nor forced heating and with which the electrode will operate with just the heat amount provided by self-heating.

Thus with indirectly heated cathode for gas discharge tube C2 of the present embodiment, since mesh member 21 is put in contact with metal oxide 10 and with double coil 41, mesh member 21 effectively forms an equipotential surface at the rear surface (surface at the opposite side of the discharge surface) of double coil 41. That is, mesh member 21 is arranged with a plurality of electrical wiring (conduction paths) and does not restrict the flow of electrical current to a single direction. The electrical resistances across the ends of the surface of mesh member 21 are thus considerably low, the surface of mesh member 21 is put in a substantially equipotential state, and the potential of the discharge surface that comprises a plurality of discharge points or discharge lines will be substantially uniform. In other words, a plurality of electrical circuits, which enable discharge current to flow in directions parallel to the discharge surface, that is, a plurality of paths (equipotential circuits) for the discharge electrons (emission) are formed by mesh member 21.

Thus with indirectly heated cathode for gas discharge tube C2, since an equipotential surface is formed effectively at the rear surface (surface at the opposite side of the discharge surface) of double coil 41 by mesh member 21 and thermionic emission thus occurs over a wide region of the equipotential surface that is formed, the discharge area is increased, the electron emission amount per unit area (electron emission density) is increased, and the load placed on the discharge position is lightened, and the sputtering of metal oxide 10 and stabilization (mineralization) due to oxidation with the reduced metal, which are degradation factors, can be restrained, in other words, the lowering of the thermionic emission ability can be restrained. As a result, the occurrence of localized discharge can be restrained and long service life of the cathode can be realized. Since the movement of the discharge position can also be restrained, stable discharge over a long period of time can be realized. Also since the discharge area is increased, the operation voltage and the generated heat amount of indirectly heated cathode for gas discharge tube C2 can be reduced.

Also, with indirectly heated cathode for gas discharge tube C2, due to the increase of the discharge area, even if the current density is slightly increased and the load is somewhat increased, that is, even if the discharge current is increased, the damage can be made less than that of the prior art. This enables the provision of an indirectly heated cathode for gas discharge tube of large discharge current with substantially the same shape as that of the prior art and the realization of pulse operation and large current operation.

Also since mesh member 21 is used as the electrical conductor, an electrical conductor of an arrangement that can restrain the degradation of thermionic emission ability and the movement of the discharge position can be realized at low cost and in a simpler manner. Also, since mesh member 21 (electrical conductor) is a rigid body, it is easy to process and can be put in close contact with metal oxide 10. Furthermore, the locations at which mesh member 21 contacts metal oxide 10 can be made numerous readily.

With indirectly heated cathode for gas discharge tube C2 of the present embodiment, since heater 1 is used as a core at the outer side of which double coil 41, which holds metal oxide 10, is positioned in a surrounding manner, and mesh member 21 is positioned at the inner side of double coil 41 so as to be in contact with metal oxide 10, the vibration restraining effect of double coil 41 is put to work and the falling off of metal oxide 10 is thereby prevented. Also, since a large amount of metal oxide 10 will be held between the pitches of double coil 41, the effect of replenishing the metal oxide loss that accompanies the degradation with time during discharge is provided.

Also, since double coil 41 has a mandrel, the additional effect that the deformation of double coil 41 during processing can be restrained is provided.

(Third Embodiment)

Figure 6:
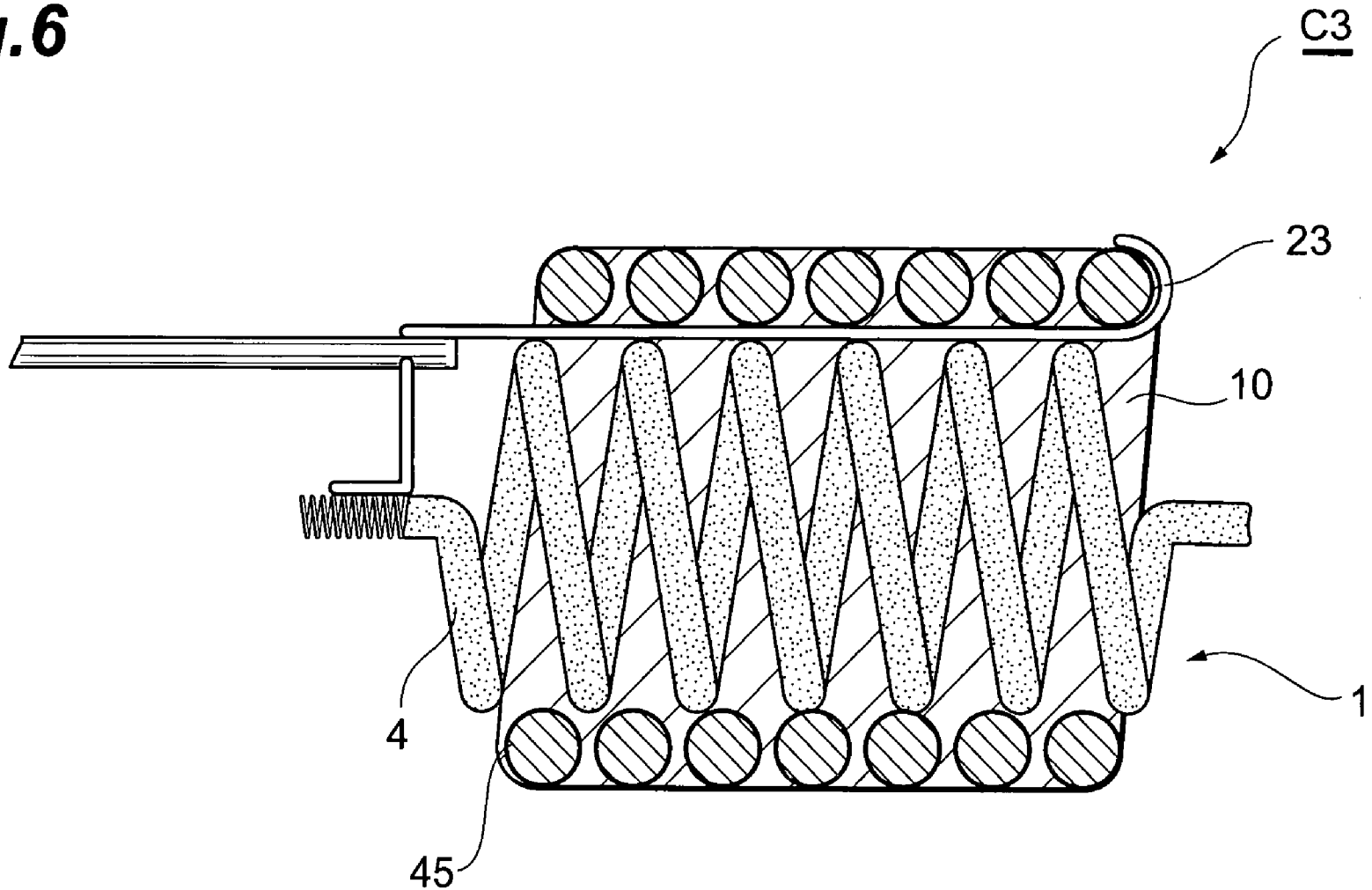
FIG. 6 is a schematic sectional view, showing an indirectly heated cathode for gas discharge tube of the third embodiment.

FIG. 6 is a schematic sectional view of an indirectly heated cathode for gas discharge tube of a third embodiment. The third embodiment differs from the first and second embodiments in that the coil member is a single coil and the electrical conductor is a wire member.

As shown in FIG. 6, indirectly heated cathode for gas discharge tube C3 has a heater 1, a single coil 45 as a coil member, a wire member 23 as an electrical conductor, and a metal oxide 10 as a material likely to emit electrons.

Single coil 45 is a coil member arranged as a coil wound in the form of a single coil and is formed by winding a tungsten element wire of 0.15 mm diameter at a diameter of 1.7 mm and a pitch of 0.18 mm. Heater 1 is disposed at the inner side of single coil 45.

Wire member 23, which is formed to a wire and has a predetermined length, is, like mesh member 21, a conductive rigid body (metal conductor) formed of a single, high-melting-point metal (with a melting point of at least 1000° C.) selected from among groups IIIa to VIIa, VIII, and Ib of the periodic table or, more specifically, from among tungsten, tantalum, molybdenum, rhenium, niobium, osmium, iridium, iron, nickel, cobalt, titanium, zirconium, manganese, chromium, vanadium, rhodium, rare earth metals, etc. or an alloy of these metals. With the present embodiment, a wire member made of tungsten is used. The diameter of wire member 23 is set to approximately 0.1 mm.

Wire member 23 is disposed at the inner side of single coil 45 (between heater 1 and single coil 45) and along the length direction of single coil 45 so as to be substantially orthogonal to the discharge direction. Wire member 23 is put in a state where it is electrically connected with single coil 45. Also, wire member 23 contacts a plurality of coil parts at the inner side of single coil 45 and thus forms a plurality of contacts with single coil 45. Wire member 23 is grounded (set to GND) by being connected, along with the ground terminal of heater 1, to a lead rod. By wire member 23 being grounded, single coil 45 is grounded as well.

Metal oxide 10 is held by single coil 45 and heater 1. The surface part of single coil 45 and metal oxide 10 are exposed to the outer side of indirectly heated cathode for gas discharge tube C3 so that the surface of metal oxide 10 and the surface part of single coil 45 make up a discharge surface and the surface part of metal oxide 10 is put in contact with the surface part of single coil 45. Metal oxide 10 is disposed in the same manner as in the first embodiment.

As shown in FIG. 6, heater 1 is in contact with metal oxide 10 and single coil 45 via electrical insulating layer 4. The heat of heater 1 can thus be transferred definitely and efficiently to metal oxide 10 and single coil 45 in the preheating process. Also, as with the first embodiment, the loss of the heat amount necessary for hot cathode operation can be restrained, and this enables designs, which require neither the supplying of heat to the electrode from the exterior nor forced heating and with which the electrode will operate with just the heat amount provided by self-heating.

Thus with indirectly heated cathode for gas discharge tube C3 of the present embodiment, since wire member 23 put in contact with metal oxide 10 and with single coil 45, wire member 23, along with the inner side part of single coil 45, effectively forms an equipotential surface at the rear surface (surface at the opposite side of the discharge surface) of single coil 45. That is, wire member 23 and the inner side part of single coil 45 are arranged with a plurality of electrical wiring (conduction paths) and do not restrict the flow of electrical current to a single direction. The electrical resistances across the ends of the surface of wire member 23 are thus considerably low, the surface of wire member 23 is put in a substantially equipotential state, and the potential of the discharge surface that comprises a plurality of discharge points or discharge lines will be substantially uniform. In other words, a plurality of electrical circuits, which enable discharge current to flow in directions parallel to the discharge surface, that is, a plurality of paths (equipotential circuits) for the discharge electrons (emission) are formed by wire member 23.

Thus with indirectly heated cathode for gas discharge tube C3, since an equipotential surface is formed effectively at the rear surface (surface at the opposite side of the discharge surface) of single coil 45 by wire member 23 and the inner side part of single coil 45 and thermionic emission thus occurs over a wide region of the equipotential surface that is formed, the discharge area is increased, the electron emission amount per unit area (electron emission density) is increased, and the load placed on the discharge position is lightened, and the sputtering of metal oxide 10 and stabilization (mineralization) due to oxidation with the reduced metal, which are degradation factors, can be restrained, in other words, the lowering of the thermionic emission ability can be restrained. As a result, the occurrence of localized discharge can be restrained and long service life of the cathode can be realized. Since the movement of the discharge position can also be restrained, stable discharge over a long period of time can be realized. Also since the discharge area is increased, the operation voltage and the generated heat amount of indirectly heated cathode for gas discharge tube C3 can be reduced.

Also, with indirectly heated cathode for gas discharge tube C3, due to the increase of the discharge area, even if the current density is slightly increased and the load is somewhat increased, that is, even if the discharge current is increased, the damage can be made less than that of the prior art. This enables the provision of an indirectly heated cathode for gas discharge tube of large discharge current with substantially the same shape as that of the prior art and the realization of pulse operation and large current operation.

Also since wire member 23 is used as the electrical conductor, an electrical conductor of an arrangement that can restrain the degradation of thermionic emission ability and the movement of the discharge position can be realized at low cost and in a simpler manner. Also, since wire member 23 (electrical conductor) is a rigid body, it is easy to process and can be put in close contact with metal oxide 10. Furthermore, the locations at which wire member 23 contacts metal oxide 10 can be made numerous readily.

Also with indirectly heated cathode for gas discharge tube C3 of the present embodiment, since heater 1 is used as a core at the outer side of which single coil 45, which holds metal oxide 10, is positioned in a surrounding manner, and wire member 23 is positioned at the inner side of single coil 45 so as to be in contact with metal oxide 10, the vibration restraining effect of single coil 45 is put to work and the falling off of metal oxide 10 is thereby prevented.

(Fourth Embodiment)

Figure 7:
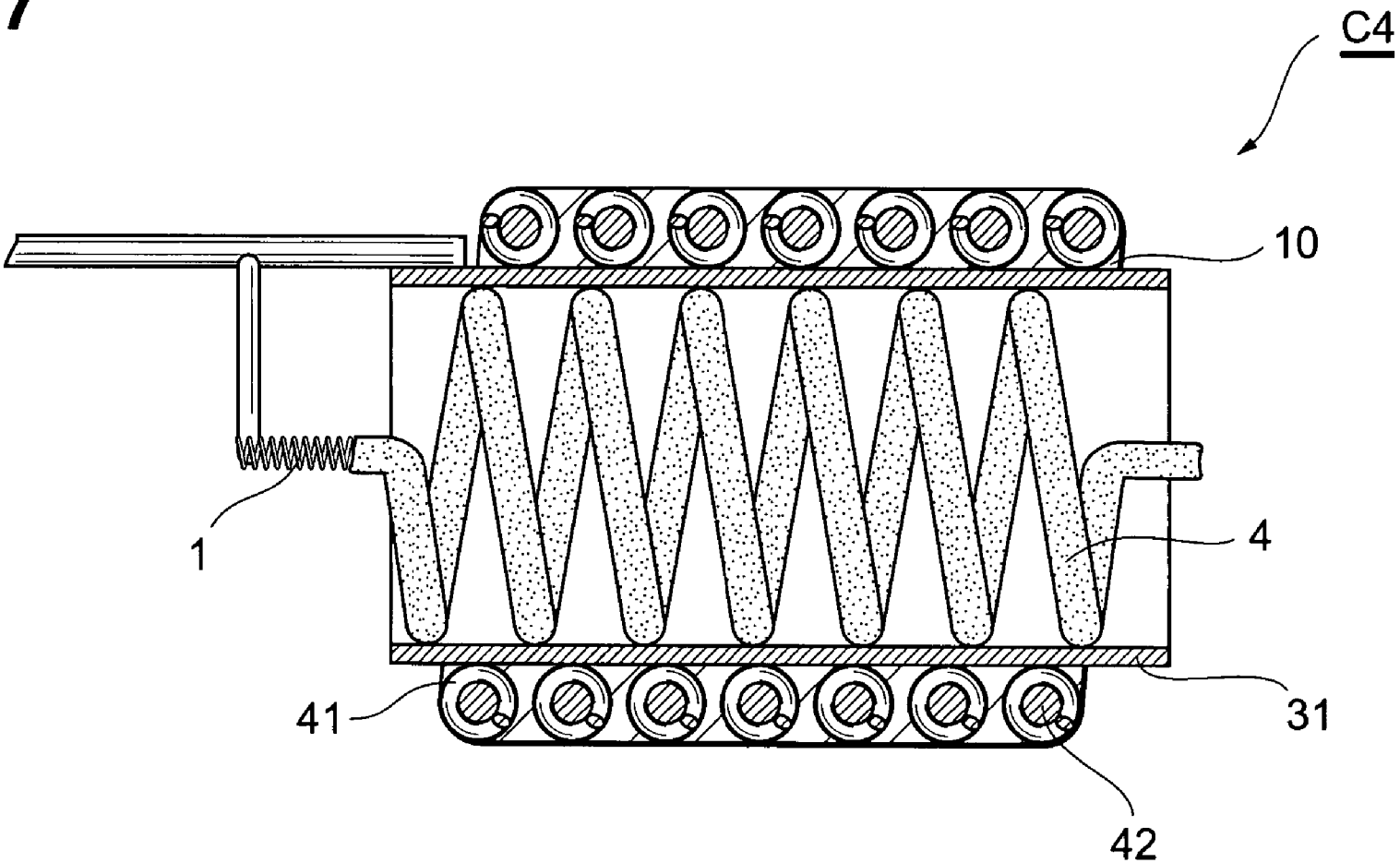
FIG. 7 is a schematic sectional view, showing an indirectly heated cathode for gas discharge tube of the forth embodiment.

FIG. 7 is a schematic sectional view of an indirectly heated cathode for gas discharge tube of a fourth embodiment. The fourth embodiment differs from the first to third embodiments in having a base metal.

As shown in FIG. 7, indirectly heated cathode for gas discharge tube C4 has a heater 1, a double coil 41, a metal oxide 10 as a material likely to emit electrons, and a base metal 31.

Base metal 31 is formed to a tubular form and is conductive. Base metal 31 is formed for example of molybdenum, etc. Heater 1 is inserted into and positioned at the inner side of this base metal 31. Double coil 41 is wound a plurality of times around and fixed to the outer surface of base metal 31. Base metal 31 functions as a barrier between metal oxide 10, which is the material likely to emit electrons, and electrical insulating layer 4, which is formed on heater 1. As base metal 31, a medium- to high-melting-point metal with a melting point that is higher than the cathode temperature during operation may be used. Also, though a tubular member of cylindrical shape is generally used as base metal 31, a tubular member with an arcuate shape with a notch (an open shape) may be used instead.

Base metal 31 is disposed at the inner side of double coil 41 (between heater 1 and double coil 41) and along the length direction of double coil 41 so as to be substantially orthogonal to the discharge direction. Base metal 31 is put in a state where it is electrically connected to double coil 41. Also, base metal 31 contacts a plurality of coil parts at the inner side of double coil 41 and thus forms a plurality of contacts with double coil 41. Base metal 31 is grounded (set to GND) by being connected, along with the ground terminal of heater 1, to a lead rod. By base metal 31 being grounded, double coil 41 is grounded as well.

Metal oxide 10 is held by double coil 41. The surface part of double coil 41 and metal oxide 10 are exposed to the outer side of indirectly heated cathode for gas discharge tube C4 so that the surface of metal oxide 10 and the surface part of double coil 41 make up a discharge surface and the surface part of metal oxide 10 is put in contact with the surface part of double coil 41.

Thus with indirectly heated cathode for gas discharge tube C4 of the present embodiment, since base metal 31 is disposed in contact with metal oxide 10 and with double coil 41, base metal 31, along with the inner side part of double coil 41, effectively forms an equipotential surface at the rear surface (surface at the opposite side of the discharge surface) of double coil 41. That is, base metal 31 and double coil 41 are arranged with a plurality of electrical wiring (conduction paths) and do not restrict the flow of electrical current to a single direction. The electrical resistances across the ends of the surface of base metal 31 are thus considerably low, the surface of base metal 31 is put in a substantially equipotential state, and the potential of the discharge surface that comprises a plurality of discharge points or discharge lines will be substantially uniform. In other words, a plurality of electrical circuits, which enable discharge current to flow in directions parallel to the discharge surface, that is, a plurality of paths (equipotential circuits) for the discharge electrons (emission) are formed by base metal 31.

Thus with indirectly heated cathode for gas discharge tube C4, since an equipotential surface is formed effectively at the rear surface (surface at the opposite side of the discharge surface) of double coil 41 by base metal 31 and double coil 41, and thermionic emission thus occurs over a wide region of the equipotential surface that is formed, the discharge area is increased, the electron emission amount per unit area (electron emission density) is increased, and the load placed on the discharge position is lightened, and the sputtering of metal oxide 10 and stabilization (mineralization) due to oxidation with the reduced metal, which are degradation factors, can be restrained, in other words, the lowering of the thermionic emission ability can be restrained. As a result, the occurrence of localized discharge can be restrained and long service life of the cathode can be realized. Since the movement of the discharge position can also be restrained, stable discharge over a long period of time can be realized. Also since the discharge area is increased, the operation voltage and the generated heat amount of indirectly heated cathode for gas discharge tube C4 can be reduced.

Also, with indirectly heated cathode for gas discharge tube C4, due to the increase of the discharge area, even if the current density is slightly increased and the load is somewhat increased, that is, even if the discharge current is increased, the damage can be made less than that of the prior art. This enables the provision of an indirectly heated cathode for gas discharge tube of large discharge current with substantially the same shape as that of the prior art and the realization of pulse operation and large current operation.

Also, since double coil 41 has a mandrel, the additional effect that the deformation of double coil 41 during processing can be restrained is provided.

Figure 8:
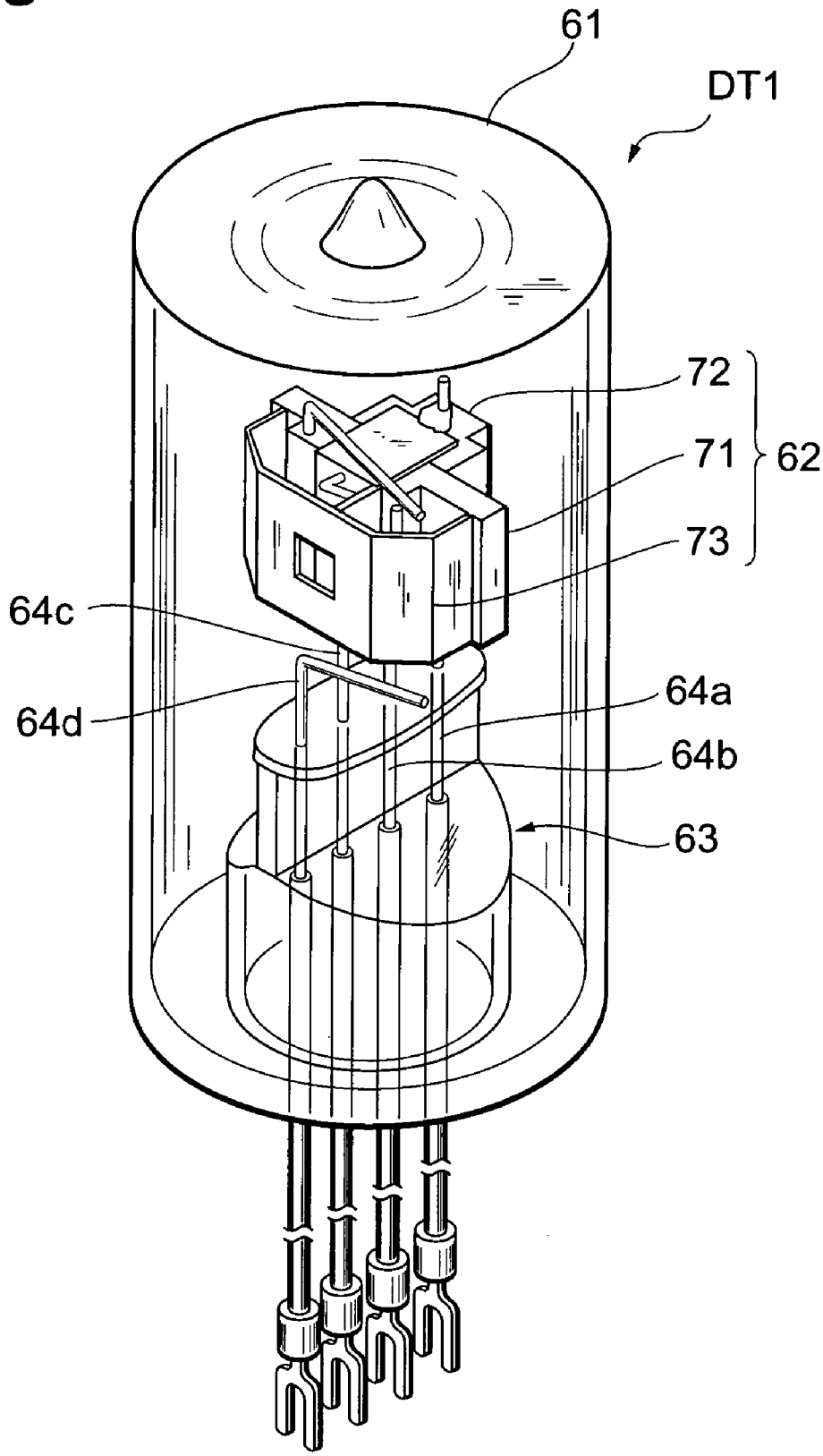
FIG. 8 is an overall perspective view, showing a first embodiment's gas discharge tube using an indirectly heated cathode for gas discharge tube.
Figure 9:
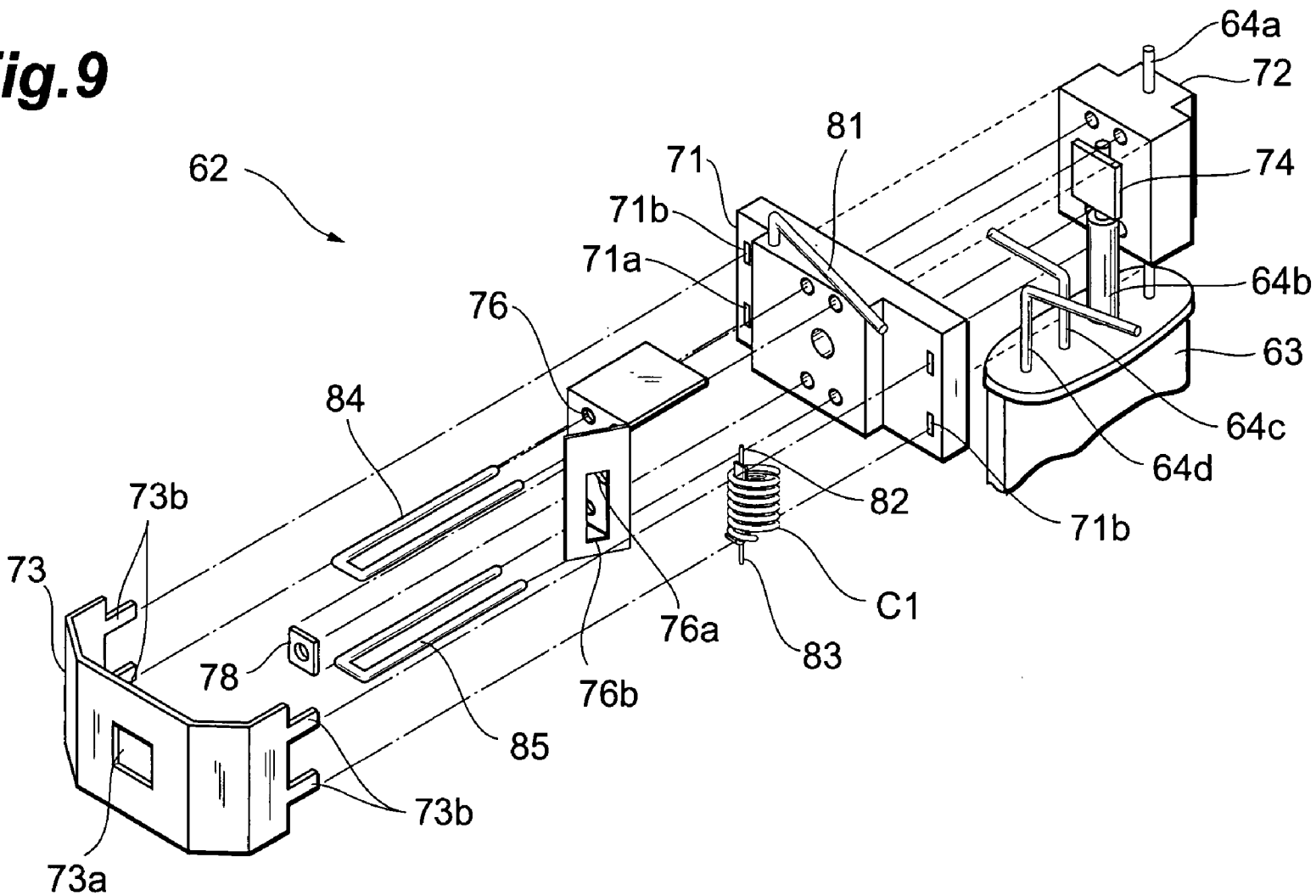
FIG. 9 is an exploded perspective view of the light emitting part of the first embodiment's gas discharge tube using an indirectly heated cathode for gas discharge tube.
Figure 10:
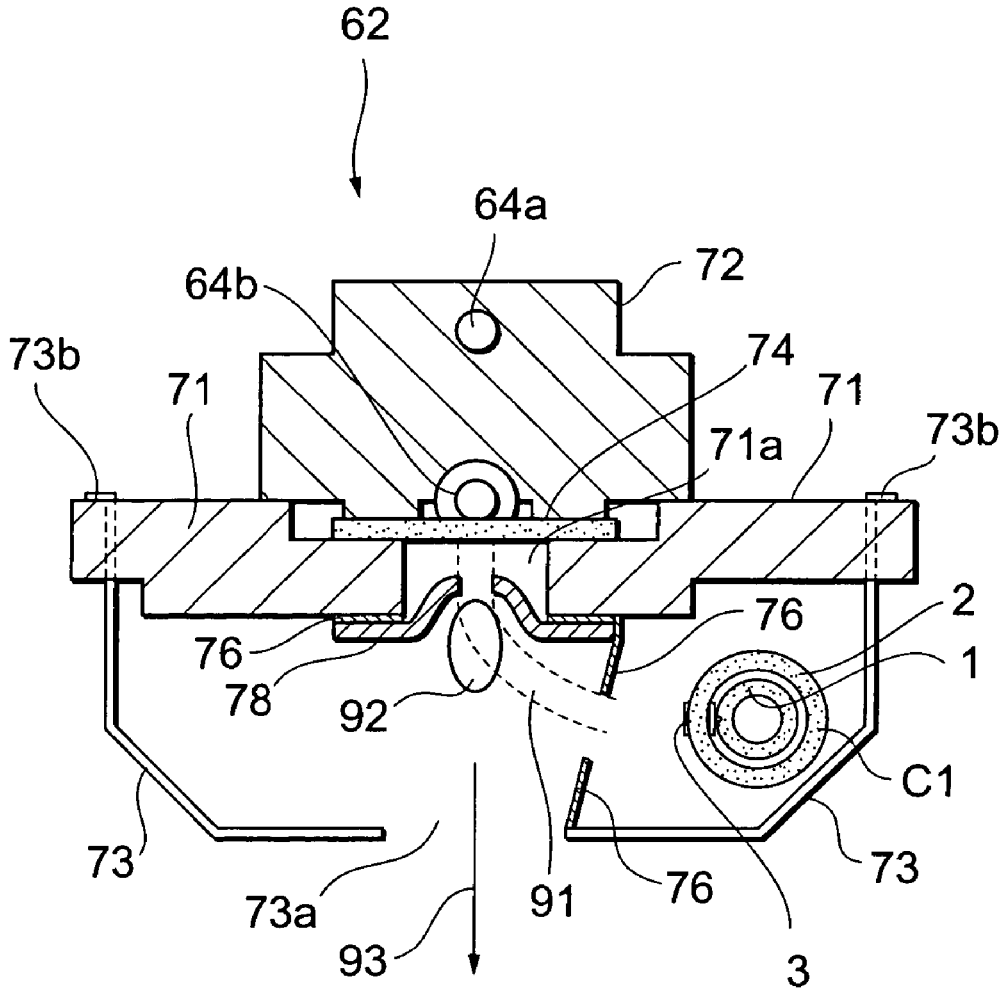
FIG. 10 is a transverse sectional view of the light emitting part of the first embodiment's gas discharge tube using an indirectly heated cathode for gas discharge tube.

Next, a gas discharge tube, which uses indirectly heated cathode for gas discharge tube C1 of the above-described arrangement, shall be described based on FIGS. 8 to 10. FIG. 8 is an overall perspective view of a gas discharge tube that uses indirectly heated cathode for gas discharge tube C1, FIG. 9 is an exploded perspective view of the light emitting part of the gas discharge tube, and FIG. 10 is a transverse sectional view of the light emitting part. With this embodiment, indirectly heated cathode for gas discharge tube C1 is applied to a side-on type deuterium gas discharge tube. As the indirectly heated cathode for gas discharge tube, any of the indirectly heated cathodes for gas discharge tube C2 to C4 maybe used in place of indirectly heated cathode for gas discharge tube C1.

A deuterium gas discharge tube DT2 has a glass outer container 61. As shown in FIG. 8, a light emitting part assembly 62 is housed inside outer container 61 and the bottom part of outer container 61 is sealed in an airtight manner by a glass stem 63. Four lead pins 64*a* to 64*d* extend from the lower part of light emitting part assembly 62 and are exposed to the exterior upon passing through stem 63. Light emitting part assembly 62 has a shielding box structure, formed by adhering together a discharge shielding plate (discharge shielding part) 71 and a supporting plate 72, both made of alumina, and a metal front cover 73, which is mounted to the front face of discharge shielding plate 71.

As shown in FIG. 9, a through hole is formed in the vertical direction at the rear part of supporting plate 72, having a protruding cross-sectional shape, and lead pin 64*a* is inserted through this through hole and held by stem 63. An indented groove, which extends vertically downwards, is formed on the front face of supporting plate 72, and lead pin 64*b*, which extends from stem 63, is set inside this groove, and by these parts, supporting plate 72 is fixed to stem 63. A flat, rectangular anode 74 is fixed facing forward on lead pin 64*b* and is held by being in contact with two protrusions formed on the front face of supporting plate 72.

Also as shown in FIG. 9, discharge shielding plate 71 is arranged as a structure with a protruding cross-sectional shape that is thinner and wider in comparison to supporting plate 72, and a through hole 71*a* is formed at a central position corresponding to anode 74. A through hole is formed in the vertical direction to a side of the protruding part of discharge shielding plate 71, and an electrode rod 81, which has been bent to an L-shape, is inserted through this through hole. In the condition where discharge shielding plate 71 and supporting plate 72 are adhered together, the lower end of electrode rod 81 and the tip of lead pin 64*c*, which has been bent into an L-shape, are welded together. An upper electrode rod 82 of an indirectly heated cathode for gas discharge tube C1 is welded to the tip part of electrode rod 81 that extends to the side, and in the condition where discharge shielding plate 71 and supporting plate 72 are adhered together, a lower electrode rod 83 is welded to the tip of lead pin 64*d*, which has been bent into an L-shape.

As shown in FIG. 9, a metal focusing electrode 76 is arranged by preparing an L-shaped metal plate, having a focusing aperture 76*a* formed coaxial to through hole 71*a* of discharge shielding plate 71 at a middle part, and bending this metal plate towards the rear at the upper part and towards the front at a side part in the direction of indirectly heated cathode for gas discharge tube C1, and at a side part, an aperture 76*b*, which has a rectangular shape that is long in the vertical direction and faces indirectly heated cathode for gas discharge tube C1, is formed. Each of discharge shielding plate 71, supporting plate 72, and focusing electrode 76 has four through holes formed at corresponding positions. Thus by inserting two metal pins 84 and 85 in the condition where discharge shielding plate 71, supporting plate 72, and focusing electrode 76 are adhered together, these components can be fixed to stem 63.

As shown in FIGS. 8 and 9, metal front cover 73 has a U-shaped cross section that is formed by bending in four stages and has an aperture window 73*a* for light projection formed at a central part. Two protrusions 73*b* are formed at each end part and these correspond to four through apertures 71*b* that are formed at the end parts of the front face of discharge shielding plate 71. Here, by inserting these protrusions 73*b* into through apertures 71*b*, front cover 73 is fixed to discharge shielding plate 71, and in this condition, the front end part of focusing electrode 76 contacts the inner face of front cover 73, and the space in which indirectly heated cathode for gas discharge tube C1 is disposed is separated from the light emitting space.

As shown in FIGS. 9 and 10, focusing electrode 76 has, at its central part, a focusing aperture 76*a* that is coaxial to through hole 71*a* of discharge shielding plate 71, and here, an aperture restricting plate 78 for restricting the aperture diameter is fixed by welding. Aperture restricting plate 78 is bent in the direction of anode 74 at the periphery of focusing aperture 76*a* and thus the distance between anode 74 and the aperture of aperture restricting plate 78 is less than the thickness of discharge shielding plate 78.

The respective electrodes inside light emitting part 62, which is assembled in the above-described manner, are positioned as shown in FIG. 10. Anode 74 is fixed by being sandwiched by discharge shielding plate 71 and supporting plate 72, and aperture restricting plate 78, which is welded to focusing electrode 76 is fixed to discharge shielding plate 71 at a position at which it faces anode 74 via through hole 71*a* of discharge shielding plate 71. Indirectly heated cathode for gas discharge tube C1 is positioned within a space surrounded by discharge shielding plate 71, front cover 73, and the surface of focusing electrode 76 provided with rectangular aperture 76*b* and at a position at which it faces aperture restricting plate 78 via rectangular aperture 76*b*.

The operation of deuterium gas discharge tube DT1 shall now be described with reference to FIG. 10. After indirectly heated cathode for gas discharge tube C1 has been heated adequately, a trigger voltage is applied across anode 74 and indirectly heated cathode for gas discharge tube C1 and discharge is thereby started. The flow path of thermions at this time is restricted to just the single path 91 (illustrated as the part sandwiched by broken lines) by the focusing by aperture restricting plate 78 of focusing electrode 76 and the shielding effect by discharge shielding plate 71 and supporting plate 72. That is, the thermions (not shown) emitted from indirectly heated cathode for gas discharge tube C1 pass through aperture restricting plate 78 from rectangular aperture 76*b* of focusing electrode 76, pass through the through hole 71*a* of discharge shielding plate 71 and reaches anode 74. An arc ball 92 due to arc discharge is generated at a space in front of aperture restricting plate 78 and at the side opposite anode 74. The light taken out from arc ball 92 is emitted substantially in the direction of arrow 93 through aperture window 73*a* of front cover 73.

Thus with deuterium gas discharge tube DT1 of the present embodiment, a deuterium gas discharge tube of long service life and stable operation can be realized by the use of any of indirectly heated cathodes for gas discharge tube C1.

Any of indirectly heated cathodes for gas discharge tube C1 to C4 may be used as an electrode (indirectly heated cathode for gas discharge tube) in a gas discharge tube besides the above-described deuterium gas discharge tube DT1, for example, in a head-on type deuterium gas discharge tube, with which light is taken out from a top part of the tube, a rare gas fluorescent lamp, a mercury fluorescent lamp, etc. Specifically, gas discharge tubes using this invention's indirectly heated electrode for gas discharge tube include a rare gas fluorescent lamp, which has discharge electrodes, forming a pair and including this invention's indirectly heated electrode for gas discharge tube, has a sealed container, on the inner surface of which is formed a fluorescent film, and with which a rare gas is sealed inside the sealed container. Gas discharge tubes using this invention's indirectly heated electrode for gas discharge tube include a mercury lamp, which has discharge electrodes, forming a pair and including this invention's indirectly heated electrode for gas discharge tube, has a sealed container, and with which a rare gas and mercury are sealed inside the sealed container. Gas discharge tubes using this invention's indirectly heated electrode for gas discharge tube include a fluorescent lamp, which has discharge electrodes, forming a pair and including this invention's indirectly heated electrode for gas discharge tube, has a sealed container, on the inner surface of which is formed a fluorescent film, and with which a rare gas and mercury are sealed inside the sealed container.

Figure 11:
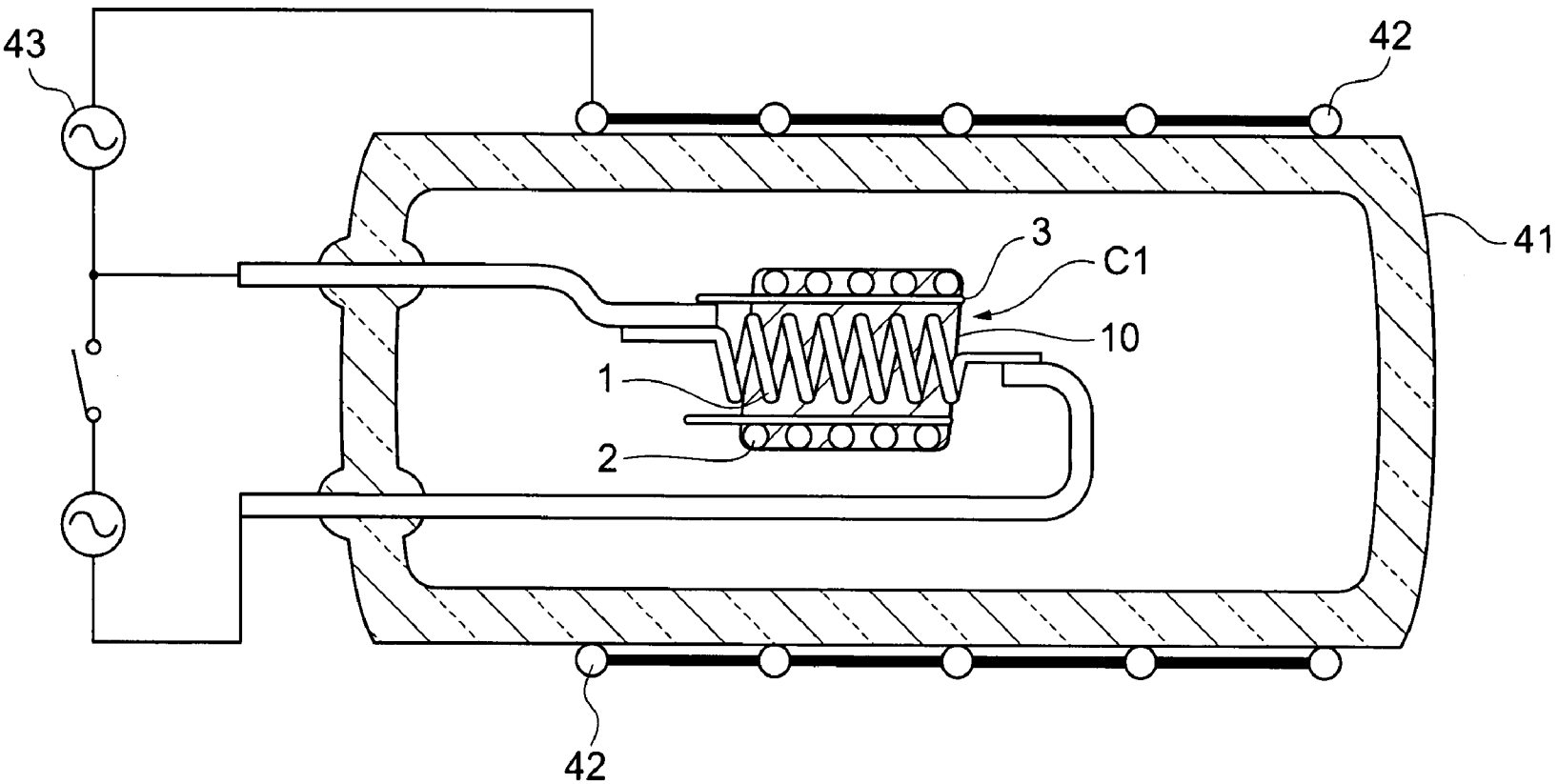
FIG. 11 is an arrangement diagram, showing a lamp with one outer electrode that uses an indirectly heated cathode for gas discharge tube of the first embodiment.

Also, making use of the characteristic of the dispersion of discharge, this invention's indirectly heated electrode for gas discharge tube may be employed in a lamp with one outer electrode, which has an electrode 42 at the exterior of a container 41, has any of indirectly heated cathodes for gas discharge tube C1 to C4 disposed inside container 41, has a rare gas sealed inside container 41, and is driven using a high-frequency power supply 43 as shown in FIG. 11. This invention's indirectly heated electrode for gas discharge tube can thus be used in the above-described low-pressure gas lamp, etc.

Figure 12:
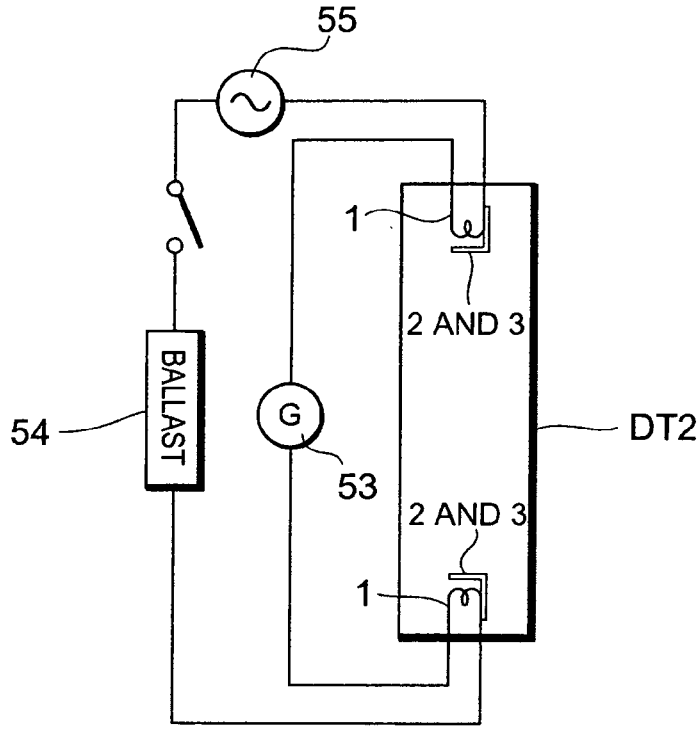
FIG. 12 is a circuit diagram, showing a first embodiment's lighting circuit for gas discharge tube using an indirectly heated cathode for gas discharge tube.

As a lighting circuit for the above-described gas discharge tube DT2, which maybe a rare gas fluorescent lamp, mercury lamp, fluorescent lamp, etc., a known, starter (preheating starting) type lighting circuit, having a glow tube 53, ballast 54, and AC power supply 55 as shown in FIG. 12, may be used. In place of a starter type, a rapid start type lighting circuit may also be used as the lighting circuit. As the driving method, a type specialized to high-frequency lighting (Hf) may also be used.

With a gas discharge tube using this invention's indirectly heated electrode for gas discharge tube, in the case of AC operation, each of the pair of electrodes (indirectly heated cathodes for gas discharge tube C1 to C4) alternatingly serves, as the main functions, the role of a cathode that emits electrons and an anode into which electrons flow. When functioning as an anode, a large amount of heat is generated at an electrode due to the voltage drop that occurs when the electrons flow in. By using the heat amount, which is generated when an electrode functions as the anode, as the heat amount necessary for thermionic emission when the electrode functions as the cathode, stable, sustained discharge can be realized without the supply of heat from heater 1 or with a lower supply of heat in comparison to DC operation during sustained discharge of the gas discharge tube.

Figure 13:
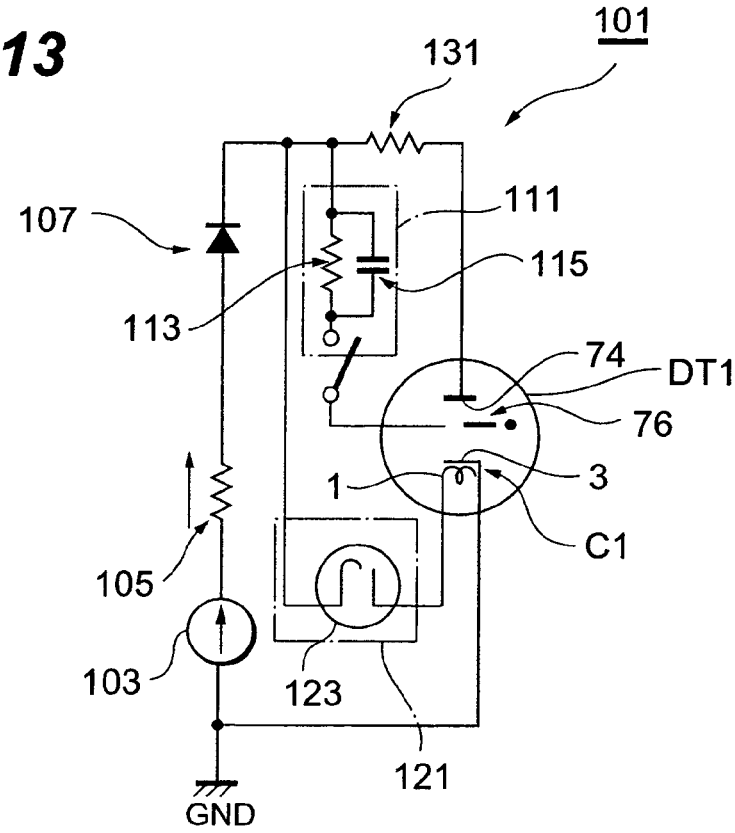
FIG. 13 is a circuit diagram, showing a first embodiment's lighting device for gas discharge tube using an indirectly heated cathode for gas discharge tube.
Figures 14A, 14B, 14C, 14D, 14E, 14F:
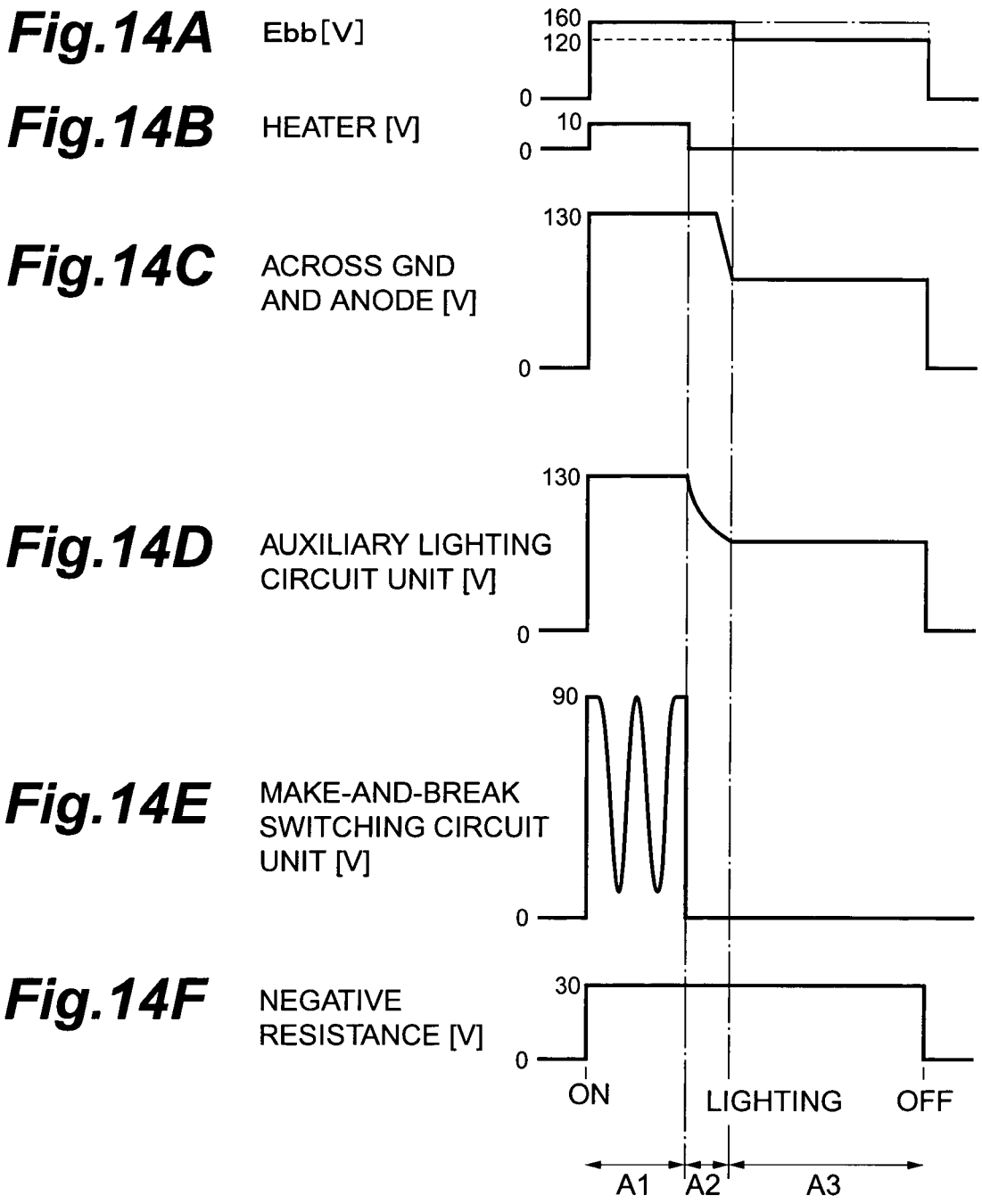
FIG. 14A is a timing chart, showing the operation voltage characteristics of the first embodiment's lighting device for gas discharge tube using an indirectly heated cathode for gas discharge tube.
FIG. 14B is a timing chart, showing the operation voltage characteristics of the first embodiment's lighting device for gas discharge tube using an indirectly heated cathode for gas discharge tube.
FIG. 14C is a timing chart, showing the operation voltage characteristics of the first embodiment's lighting device for gas discharge tube using an indirectly heated cathode for gas discharge tube.
FIG. 14D is a timing chart, showing the operation voltage characteristics of the first embodiment's lighting device for gas discharge tube using an indirectly heated cathode for gas discharge tube.
FIG. 14E is a timing chart, showing the operation voltage characteristics of the first embodiment's lighting device for gas discharge tube using an indirectly heated cathode for gas discharge tube.
FIG. 14F is a timing chart, showing the operation voltage characteristics of the first embodiment's lighting device for gas discharge tube using an indirectly heated cathode for gas discharge tube.
Figures 15A, 15B, 15C, 15D, 15E:
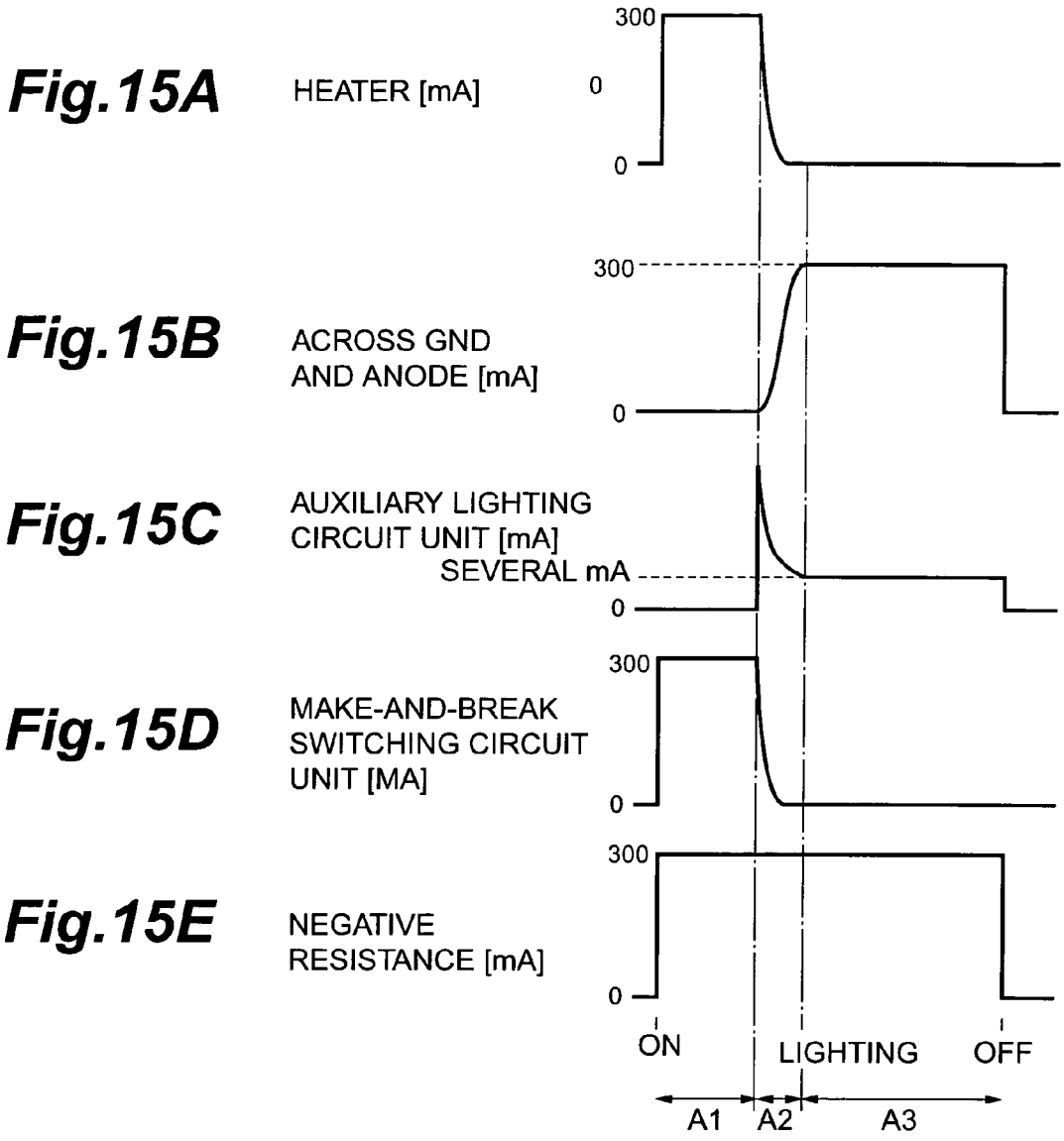
FIG. 15A is a timing chart, showing the operation current characteristics of the first embodiment's lighting device for gas discharge tube using an indirectly heated cathode for gas discharge tube.
FIG. 15B is a timing chart, showing the operation current characteristics of the first embodiment's lighting device for gas discharge tube using an indirectly heated cathode for gas discharge tube.
FIG. 15C is a timing chart, showing the operation current characteristics of the first embodiment's lighting device for gas discharge tube using an indirectly heated cathode for gas discharge tube.
FIG. 15D is a timing chart, showing the operation current characteristics of the first embodiment's lighting device for gas discharge tube using an indirectly heated cathode for gas discharge tube.
FIG. 15E is a timing chart, showing the operation current characteristics of the first embodiment's lighting device for gas discharge tube using an indirectly heated cathode for gas discharge tube.

A lighting device suitable for deuterium gas discharge tube DT1 that uses indirectly heated cathode for gas discharge tube C1 shall now be described based on FIG. 13. FIG. 13 is a circuit diagram, showing a lighting device for deuterium gas discharge tube DT1 that uses indirectly heated cathode for gas discharge tube C1.

A lighting device 101 comprises a constant current power supply 103, connected as a power supply between indirectly heated cathode for gas discharge tube C1 and anode 74 of deuterium gas discharge tube DT1, an auxiliary lighting circuit unit 111, connected between anode 74 and focusing electrode 76 in order to generate a trigger discharge across indirectly heated cathode for gas discharge tube C1 and focusing electrode 76, a make-and-break switching circuit unit 121, connected between indirectly heated cathode for gas discharge tube C1 and anode 74 and supplying electricity to a heater 1 for a predetermined period and then cutting off the supply of electricity to heater 1 after the elapse of the predetermined period, and a fixed resistor 131 for current detection, serially connected and installed between anode 74 and constant current power supply 103.

Constant current power supply 103 supplies a DC open voltage of approximately 160V and a steady-state current of approximately 300 mA. A negative resistance 105 and a diode 107 for discharge stabilization are connected serially to this constant current power supply 103. Negative resistance 105 is set to approximately 50 to 150 Ω.

Auxiliary lighting circuit unit 111 includes a fixed resistor 113, which is serially connected and installed between anode 74 and focusing electrode 76, and a capacitor 115, which is connected in parallel to this fixed resistor 113. Make-and-break switching circuit unit 121 includes a glow tube 123. A switch, which is opened after operation (lighting) of deuterium gas discharge tube DT1 may be provided between auxiliary lighting circuit unit 111 and focusing electrode 76. Also, in place of a glow starter system using glow tube 123, an electronic starting system using a semiconductor element with a timer function or a mechanical (contact) switch, which may or may not have a timer function, may be used.

The operation of lighting device 101 shall now be described based on FIGS. 14A to 14F and 15A to 15E.

Though not illustrated in FIG. 13, when a main power switch of lighting device 101 for deuterium gas discharge tube DT1 is switched ON (start), power is supplied from constant current power supply 103 to glow tube 123, glow discharge occurs at glow tube 123, and by mutual contact of the electrodes of glow tube 123, power is supplied to heater 1 of indirectly heated cathode for gas discharge tube C1, and indirectly heated cathode for gas discharge tube C1 is thereby preheated (period A1 in FIGS. 14A to 14F and 15A to 15E). At this point, a voltage of approximately 130V is applied across indirectly heated cathode for gas discharge tube C1 and anode 74 from constant current power supply 103 and an electric field directed from anode 74 to indirectly heated cathode for gas discharge tube C1 is generated.

When these preparations for trigger discharge have been made, the glow discharge at glow tube 123 stops and by the separation of the electrodes of glow tube 123, a potential of approximately 130V is generated at focusing electrode 76 from constant current power supply 103 and via the parallel-connected capacitor 115 and fixed resistor 113, and a trigger discharge is generated across indirectly heated cathode for gas discharge tube C1 and focusing electrode 76 (period A2 in FIGS. 14A to 14F and 15A to 15E).

By thus causing a trigger discharge to occur, an arc discharge is made to occur across indirectly heated cathode for gas discharge tube C1 and anode 74, and based on the current of approximately 300 mA that is supplied across indirectly heated cathode for gas discharge tube C1 and anode 74 from constant current power supply 103, arc discharge is sustained in a stable manner until the main power switch is turned OFF (period A3 in FIGS. 14A to 14F and 15A to 15E). During operation (lighting) of deuterium gas discharge tube DT1, the voltage applied to deuterium gas discharge tube DT1 from constant current power supply 103 is lowered, by fixed resistor 131, from the approximately 160V in the starting process to approximately 120V.

Since deuterium gas discharge tube DT1 using indirectly heated cathode for gas discharge tube C1 can be driven in accordance to the relationships expressed by the following equations (3) and (4);

$$I_{f0}=Ip \quad (3)$$

$$V_{f1}=0 \quad (4)$$

In the above, $I_{f0}$: initial supply current to the heater in the starting state Ip: discharge current $V_{f1}$: voltage applied to the heater during operation With lighting device 101, a lighting device for lighting deuterium gas discharge tube DT1 using indirectly heated cathode for gas discharge tube C1 can be realized. Also, since a single constant current power supply 103 can be used for the preheating of indirectly heated cathode for gas discharge tube C1, for the starting of the trigger discharge (discharge by initial gas ionization), and for the main discharge, a power supply for preheating (heater) of indirectly heated cathode for gas discharge tube C1 is made unnecessary in particular, thus enabling significant reduction of the number of parts and simplification of arrangement.

Also, with lighting device 101, since make-and-break switching circuit unit 121 includes a glow tube 123, make-and-break switching circuit unit 121 can be realized simply and at low cost. Furthermore, since auxiliary lighting circuit unit 111 includes fixed resistor 113 and capacitor 115, auxiliary lighting circuit unit 111 can be realized simply and at low cost.

Also, with lighting device 101, since a fixed resistor 131 for current detection is provided, the voltage during operation of deuterium gas discharge tube DT1 can be lowered and the consumption power of deuterium gas discharge tube DT1 can thus be lowered.

Though in the present embodiment, a high-melting-point metal is used as the electrical conductor, a porous metal of low thickness, carbon fibers, etc. may be used in place of a high-melting-point metal. Also for improvement of the sputter resistance and improvement of the discharge performance of metal oxide 10, a nitride or carbide of tantalum, titanium, niobium, etc. maybe attached to the surface of metal oxide 10 or to double coil 2 or 41, single coil 45, plate member 3, mesh member 21, or wire member 23.

Also, though the surface part of double coil 2 or 41 or single coil 45 is exposed in the present embodiment, this does not have to be exposed necessarily, and as long as the surface part of double coil 2 or 41 or single coil 45 is in contact with metal oxide 10, the surface part of double coil 2 or 41 or single coil 45 may be covered with metal oxide 10. By exposing the surface part of double coil 2 or 41 or single coil 45, the discharge property can be improved.

INDUSTRIAL APPLICABILITY

This invention's indirectly heated electrode for gas discharge tube can be used as an indirectly heated electrode (indirectly heated cathode) of a rare gas lamp, rare gas fluorescent lamp, mercury lamp, mercury fluorescent lamp, deuterium lamp, etc

The invention claimed is:

1. An indirectly heated electrode for gas discharge tube comprising:

a coil member, wound in coil form;

a heater, disposed at the inner side of said coil member and having an electrical insulating layer formed on a surface thereof;

a metal oxide, serving as a material likely to emit electrons and held by said coil member; and an electrical conductor, having a predetermined length and disposed at the inner side of said coil member so as to be in contact with said coil member, wherein said metal oxide contacts said heater via said electrical insulating layer, and wherein said coil member is a multiple coil arranged by winding a coil having a mandrel in coil form, the mandrel having a cross section and the coil member being wound contiguously about the mandrel so as to define an inside shape that corresponds to the cross section of the mandrel.

2. The indirectly heated electrode for gas discharge tube as set forth in claim 1, wherein said electrical conductor is disposed so as to be in contact with said metal oxide and in contact with a plurality of coil parts of said coil member.

3. The indirectly heated electrode for gas discharge tube as set forth in claim 1, wherein said electrical conductor is a high-melting-point metal formed to a mesh, a wire, or a plate.

4. The indirectly heated electrode for gas discharge tube as set forth in claim 1, wherein said metal oxide is an oxide of a single metal among barium, strontium, and calcium or a mixture of oxides of these metals or contains an oxide of a rare earth metal.

5. An indirectly heated electrode for gas discharge tube comprising:

a coil member, having a mandrel and wound in coil form, the mandrel having a cross section and the coil member being wound contiguously about the mandrel so as to define an inside shape that corresponds to the cross section of the mandrel;

a heater, disposed at the inner side of said coil member and having an electrical insulating layer formed on a surface thereof;

a high-melting-point metal, formed to a mesh, a wire, or a plate and disposed along the length direction of said coil member between said coil member and said heater; and a metal oxide, serving as a material likely to emit electrons and disposed so as to be in contact with said coil member; and wherein said high-melting-point metal is in electrical contact with said coil member at a plurality of locations and said coil member is grounded.

6. An indirectly heated electrode for gas discharge tube comprising:

a coil member, having a mandrel and wound in coil form, the mandrel having a cross section and the coil member being wound contiguously about the mandrel so as to define an inside shape that corresponds to the cross section of the mandrel;

a heater, disposed at the inner side of said coil member and having an electrical insulating layer formed on a surface thereof;

a high-melting-point metal, formed to a mesh, a wire, or a plate and disposed along the length direction of said coil member between said coil member and said heater; and a metal oxide, serving as a material likely to emit electrons and disposed so as to be in contact with said coil member; and wherein said high-melting-point metal is in electrical contact with said coil member at a plurality of locations and said high-melting-point metal is grounded.

7. The indirectly heated electrode for gas discharge tube as set forth in any of claims 5 through 6, wherein said coil member is a multiple coil formed by winding a coil in coil form.

* * * * *